US005316187A

United States Patent [19]

Drobish et al.

[11] Patent Number: 5,316,187

[45] Date of Patent: May 31, 1994

[54] PUMP PISTONS FOR PRESSURIZING LIQUID DISPENSING CONTAINERS

[75] Inventors: James L. Drobish, Wyoming; Frank A. Ciboch, Jr., Forest Park; Robert A. Paul, Fairfield; Jimmy C. Edwards, Cincinnati; Lawrence E. Robbins, Hamilton, all of Ohio

[73] Assignee: The Procter & Gamble Company, Cincinnati, Ohio

[21] Appl. No.: 7,939

[22] Filed: Jan. 25, 1993

Related U.S. Application Data

[63] Continuation-in-part of Ser. No. 980,867, Nov. 24, 1992, abandoned.

[51] Int. Cl.[5] ..... B65D 83/00

[52] U.S. Cl. ..... 222/401; 222/209; 239/357; 239/361; 417/545; 417/550

[58] Field of Search ..... 222/207, 401, 209; 417/545, 550; 239/355, 357, 360, 361

[56] References Cited

U.S. PATENT DOCUMENTS

| | | | |
|---|---|---|---|
| 356,750 | 2/1887 | Cully . | |
| 860,659 | 7/1907 | Hecker . | |
| 1,000,286 | 8/1911 | Moulin . | |
| 1,192,509 | 7/1916 | Feeny . | |
| 1,623,504 | 4/1927 | Stiriss . | |
| 2,362,080 | 11/1944 | Martin | 222/321 |
| 2,730,958 | 1/1956 | Nelson | 103/178 |
| 2,922,380 | 1/1960 | Pedlow, Jr. et al. | 417/550 |
| 3,228,347 | 1/1966 | Corsette | 103/178 |
| 3,536,424 | 10/1970 | Plos | 417/545 |
| 3,586,068 | 6/1971 | Nicholson | 141/20 |
| 3,656,482 | 4/1972 | Sunnen | 128/261 |
| 3,955,720 | 5/1976 | Malone | 222/396 |
| 4,077,442 | 3/1978 | Olofsson | 141/20 |
| 4,140,410 | 2/1979 | Garcia | 401/150 |
| 4,165,025 | 8/1979 | Mascia et al. | 222/401 |
| 4,197,884 | 4/1980 | Maran | 141/383 |
| 4,492,320 | 1/1985 | Tada | 222/398 |
| 4,850,517 | 7/1989 | Ter Stege | 222/402.18 |
| 4,941,599 | 7/1990 | Reinertz et al. | 222/401 |
| 4,948,092 | 8/1990 | Kasper et al. | 251/82 |
| 5,127,804 | 7/1992 | Chappell | 417/231 |

FOREIGN PATENT DOCUMENTS

| | | | |
|---|---|---|---|
| 4541347 | 9/1966 | Japan | 239/360 |

*Primary Examiner*—Gregory L. Huson

*Attorney, Agent, or Firm*—William Scott Andes; E. Kelly Linman

[57] ABSTRACT

The present invention presents an improved pump piston for pressurizing liquid dispensing containers, and more particularly improved air inlet valve designs for such pistons. According to the present invention, the inlet valves are located remotely from the lower end of the pump piston, such that they are protected from contamination by liquid product and resulting degradation of performance. One inlet valve design utilizes a lost motion connection between the pump piston and upper cap, with structural elements of the upper cap and piston cooperating to form an inlet valve that is opened to admit air into the interior of the piston when the cap is pulled upward and tightly sealed when the cap is pushed downward. Another inlet valve design utilizes slits in the wall of the piston itself and the flexibility of the piston material to form an inlet valve that is opened to admit air into the interior of the piston when the cap is pulled upward and tightly sealed when the cap is pushed downward. The lost motion design is disclosed in two possible embodiments, and a number of versions of the valve slit embodiment are disclosed.

25 Claims, 22 Drawing Sheets

PUMP PISTONS FOR PRESSURIZING LIQUID DISPENSING CONTAINERS

CROSS-REFERENCE TO RELATED APPLICATION

This application is a continuation-in-part of application Ser. No. 07/980,867, filed Nov. 24, 1992, now abandoned.

FIELD OF THE INVENTION

The present invention pertains to improvements in pneumatic pump pistons for pressurizing liquid dispensing containers, and more particularly to improved air inlet valve designs which are protected from product residue.

BACKGROUND OF THE INVENTION

In recent times, there has been a heightened awareness on the part of the general public as to the environmental impact of certain types of aerosol propellants. In particular, aerosol propellants for paint, hairspray, insecticides, cleaners, and the like have been singled out as major contributors to depletion of the ozone layer which protects the earth from excessive ultraviolet radiation from the sun. This is due to the fact that for a number of years, aerosol containers contained propellants comprised of chlorofluorocarbons (CFCS) which, when liberated in the course of dispensing the product, reacted with the atmospheric ozone layer and caused it to become depleted. Chlorofluorocarbons typically consist of carbon, chlorine, fluorine, and hydrogen.

While most if not all use of chlorofluorocarbons has been eliminated in view of safer alternatives, many consumers continue to perceive aerosol containers in a negative light. Even though the environmental impact of aerosol containers has been reduced, widespread use of other chemical propellants may have other long-term consequences in the years to come. For example, volatile organic compounds (VOCS) such as butane, propane, and other hydrocarbons may contribute to pollution problems in the lower atmosphere.

These consumer perceptions have led to a resurgence in liquid dispensing containers which use no propellants at all. In particular, there has been a proliferation of pump-type spray devices which dispense a preset amount of liquid product with each stroke of a piston-type liquid pump. While improvements in dispensing valve and spray head technology have improved the quality of the resulting spray pattern produced by these devices, the consumer is still required to manually pump the piston numerous times to dispense the typical quantity of product required. The consumer thus receives a number of short spray bursts of product rather than a continuous, consistent spray as from an aerosol-type container. Many consumers find this dispensing mechanism too time and effort intensive, and find the spray burst method of operation unsatisfactory. Additionally, such pump spray mechanisms often produce different spray characteristics from an aerosol dispenser. Moreover, in order to achieve an acceptable pattern of spray, these devices often produce a very "wet" spray with too much liquid product dispensed per unit area for many applications.

An approach which has proven satisfactory in terms of consumer perceptions is the use of compressed air as a propellant. The liberation of compressed air has no negative environmental consequences beyond those of the liquid product itself, and such dispensing containers behave much like those aerosol containers which use chemical propellants in terms of spray quantity and quality.

One way to utilize compressed air is to prepressurize sealed containers at the factory with air, much like containers utilizing chemical propellants. The difference is, however, that with chemical propellants such as CFCs or VOCs, the propellants are actually in a liquified state in the container and boil as required to maintain a relatively constant vapor pressure in the container as the headspace increases during the course of product dispensing. In this fashion, a constant pressure is available throughout the course of dispensing the contents of the container to maintain uniform spray quality. With compressed air in a gaseous state, the pressure in the container decreases as the headspace increases in the course of product dispensing, leading to progressively poorer spray quality. With a conventional sealed container, the only ways to combat this tendency are either to use greater than normal volumes of compressed air or comparable volumes at higher pressures to dispense a comparable quantity of liquid product to containers utilizing chemical propellants. This means either larger containers for the same product quantity, or strengthened containers for higher pressures which are more costly. Even so, unlike chemical propellants which maintain a relatively constant pressure within the container during the course of dispensing its contents, with prepressurized containers utilizing compressed air the spray pattern will change as the air pressure within the container drops in use. Although the pattern may remain acceptable throughout much of the range of use, consumers will notice the inevitable difference in spray characteristics when the pressure varies to such a large extent, say from a typical 150 psi (1034 kPa) down to 30 psi (207 kPa) or less.

A solution which is currently being marketed is to design a container which the consumer pressurizes with atmospheric air periodically during the course of dispensing the contents of the container. This offers numerous advantages, including the possibility of making the containers refillable by the consumer to reduce costs and household waste, the non-chemical nature of the propellant, and the aerosol-quality spray characteristics. By allowing the air in the container to be replenished and additional air to be added to account for the increasing headspace as product is dispensed, a much more uniform level of pressure is available for dispensing without the need for a larger container or a special strengthened container. Such containers have an air pump apparatus, usually in conjunction with the dispensing valve assembly, for operation by the consumer to pressurize the container.

One such dispensing container for hairspray which is currently marketed in the United States comprises a plastic container with a removable valve/pump assembly such that the container is easily refilled by the consumer. U.S. Pat. No. 4,077,442, issued Mar. 7, 1978 to Olofsson, exemplifies this arrangement, and is hereby incorporated herein by reference. A removable pump piston attached to an upper cap surrounds the dispensing valve assembly and slides within an annular pumping chamber. This pump piston design utilizes a lip-type lower seal which contacts the outer wall of the chamber to form an air-tight seal, and an inlet valve immediately adjacent to the seal in the form of a slit in the piston wall. This pump piston also utilizes a small bleed hole in the piston wall to permit residual compressed air within the piston (from the final downward stroke) to bleed out such that the container can be stored with the pump piston installed in the lowered position.

The consumer reciprocates the pump piston to compress air within the confines of the piston/chamber combination and force it into the container through a one-way valve. Approximately 10–15 pump strokes are sufficient to initially pressurize the container (more precisely, to pressurize the headspace above the liquid in the container), and continuous dispensing is possible until the pressure in the container is reduced to the point where the spray pattern is no longer satisfactory. The consumer then re-pressurizes the container as needed throughout the course of dispensing the contents of the container. When the contents of the container are exhausted, the consumer can remove the piston, pumping chamber, and dispensing valve assembly, and pour an appropriate amount of liquid product into the container to refill and reuse the existing container. Upon reassembly, the consumer can then re-pressurize the container and again dispense the desired product.

Unfortunately, as the air pressure in the container decreases during use to a point below which spray effectiveness is greatly reduced, liquid product tends to dribble down from the spray outlet into the annular pumping chamber. When the pump piston is then inserted into the chamber and pumping is attempted, the inlet valve slit at the lower end of the piston becomes contaminated with the product. With some products this does not present any particular difficulty. With other products (such as hairspray) which become sticky when dry, however, exposure to air causes the liquid product to dry in and around the valve slit. The congealed product either effectively glues the edges of the valve slit together or prevents air-tight sealing of the opening, thus leading to degradation of sealing performance of the valve slit. As the performance deteriorates to the point of a complete inability to admit air into the piston or to effectuate air-tight sealing, the consumer finds himself or herself unable to pump sufficient air into the container for proper functioning.

The present invention is directed to improving the inlet valve design to protect it from exposure to contamination by liquid product, and thus improve reliability in the course of consumer usage. Specific attributes and advantages of this invention will be apparent with reference to the accompanying Specification and Drawing Figures.

SUMMARY OF THE INVENTION

The contamination problems which often occur when certain products are used with the prior art design of the pump piston may be obviated by the relocation of the inlet valve to the upper portion of the piston. The prior art inlet valve design utilizing a single valve slit, however, will not perform satisfactorily if merely translated to the upper portion of the piston because the lip-type seal is not adjacent to the slit to cause it to open and close.

Pump pistons according to the present invention offer improved valve designs which provide reliable sealing of the inlet valve, and consequently reliability in the course of consumer usage. These improved pistons maintain the simplicity of the prior art in that there are only two individual components to fabricate and assemble, namely the upper cap and the piston itself. Simplicity equates to low manufacturing costs and reliability in consumer usage.

In one embodiment of the present invention, a so-called "lost motion" valve arrangement is utilized. The pump piston assembly includes an upper cap suitably shaped to enclose the top of the container and adapted for manipulation by the consumer. The assembly also includes a tubular piston having an upper end connected to the underside of the upper cap and a lower end sized to be slideably received within the pumping chamber (which is part of the dispensing valve assembly). The tubular piston also includes an annular seal at its lower end for engaging the outer cylindrical wall of the pumping chamber.

The inlet valve mechanism in this embodiment is formed by structural elements of the upper cap and the tubular piston themselves. The valve operation is accomplished by the lost motion (i.e., the relative motion permitted) between the upper cap and the piston. The piston itself is closed at its upper end and open at its lower end, and near the end which is connected to the upper cap the piston is formed with a tapered shoulder which extends around the periphery of the piston. The upper cap has a tapered conduit which extends down from the upper surface and surrounds the upper end of the piston. This tapered conduit has an annular sidewall at its juncture with the upper cap and defines an opening through the upper surface of the upper cap through which the upper end of the piston extends. The upper end of the piston includes a retaining lip which is larger than this opening and abuts the upper end of the tapered conduit to retain the piston in engagement with the upper cap and limit the relative motion between the two. The piston further includes at least one aperture extending through the tapered shoulder of the piston for admitting air into the interior of the piston.

The tapered conduit is sized and disposed to engage the tapered shoulder to block off the apertures to form an airtight seal when force exerted downwardly on the upper cap forces the piston and upper cap into firm engagement in a first position, whereby compressed air is then forced into the container. When the consumer pulls upward on the upper cap, the piston and upper cap move into a second position wherein the tapered conduit and tapered shoulder are not engaged, thus permitting air to enter the interior of the piston. In this position, the retaining lip engages the upper end of the tapered conduit to prevent the piston and upper cap from becoming separated.

In a second embodiment of the present invention, the pump piston assembly includes the same basic structural elements as the first embodiment. Likewise, in this embodiment, the inlet valve mechanism in this embodiment is formed by structural elements of the upper cap and the tubular piston themselves. The valve operation is accomplished by the lost motion (i.e., the relative motion permitted) between the upper cap and the piston. This embodiment differs from the first embodiment in that the piston itself is open at both ends, and near the end which is connected to the upper cap the piston is formed with an annular channel and an outer edge which extends around the periphery of the piston. The upper cap has a tubular conduit which extends down from the upper surface and surrounds the upper end of the piston. This tubular conduit has a radially inwardly extending annular ring, or segments of an annular ring, which is sized and disposed to engage the outer edge to retain the piston in engagement with the upper cap and limit the relative motion between the two.

The upper edge of the piston constitutes a sealing surface, and the upper cap has a sealing ring sized and disposed to engage this sealing surface to form an airtight seal when force exerted downwardly on the upper cap forces the piston and upper cap into firm engagement in a first position, whereby compressed air is then forced into the container. When the consumer pulls upward on the upper cap, the piston and upper cap move into a second position wherein the sealing surface and sealing ring are not engaged, thus permitting air to enter the interior of the piston. In this position, the annular ring engages the outer edge to prevent the piston and upper cap from becoming separated.

In a third embodiment of the present invention, the pump piston assembly includes the same basic structural elements as the first and second embodiments. However, the inlet valve mechanism in this embodiment differs from the first and second embodiments in that the mechanism is formed by the wall of the piston itself. Pump piston assemblies in accordance with this embodiment utilize a plurality of slits extending through the wall of the piston itself to form a flexible valve which opens when the piston is drawn upwards and closes to form an airtight seal when the piston is pushed downward within the pumping chamber. A potentially infinite number of versions of this embodiment are possible, but a presently preferred version of this embodiment of the present invention utilizes two diametrically opposed slits, spaced apart longitudinally (axially) on the piston, which have ends spaced apart circumferentially with respect to the piston such that the slits are also spaced apart circumferentially.

BRIEF DESCRIPTION OF THE DRAWINGS

The present invention will be better understood with reference to the following Detailed Description and to the accompanying Drawing Figures, in which.

DETAILED DESCRIPTION OF THE PREFERRED EMBODIMENTS

Figure 1:
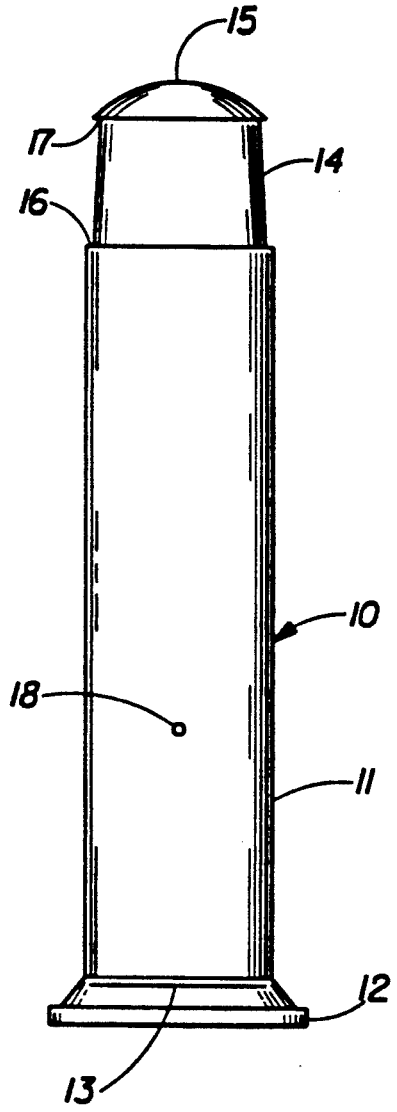
Fig. 1 ( Prior Art )
FIG. 1 is an elevational view of a pump piston according to the prior art, with the inlet valve in the normal (closed) position.
Figure 2:
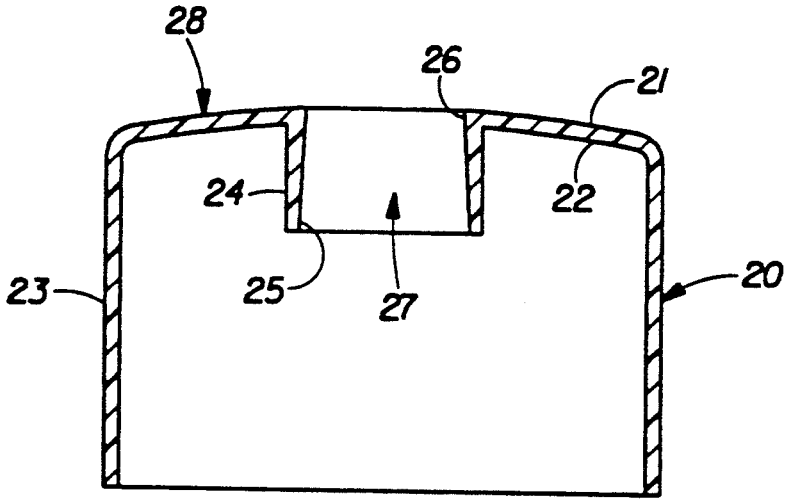
Fig. 2 ( Prior Art )
FIG. 2 is an elevational sectional view of an upper cap according to the prior art.
Figure 3:
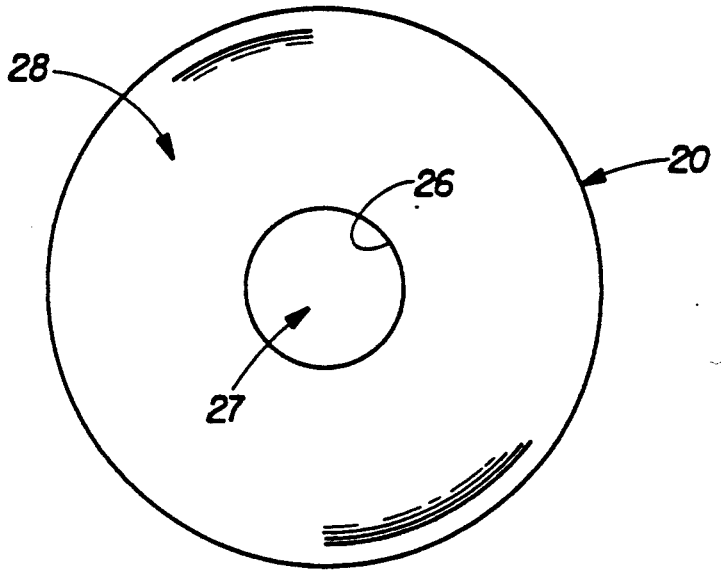
Fig. 3 ( Prior Art )
FIG. 3 is a plan view of the upper cap of FIG. 2.

In the Drawing Figures, FIGS. 1–7 depict one version of a prior art pump piston currently marketed in the United States, which generally corresponds to the assembly disclosed in U.S. Pat. No. 4,077,442, as discussed above.

Referring to FIGS. 1–7, the numeral 10 refers generally to the pump piston, which is currently injection molded in one unitary piece from low density polyethylene. The pump piston 10 includes a cylindrical outer wall 11 with an annular seal 12 at one end and a rounded tip 15 at the other end. The outer wall 11 has an annular channel 14 which extends around the periphery of the piston 10 in the vicinity of the rounded tip 15 for engaging the upper cap, generally denoted by the numeral 20, in a manner to be described below. The channel is defined by edges 16 and 17. The outer wall 11 further includes an inlet valve 13 in the form of a slit, and a small circular bleed hole 18.

The upper cap 20 has a generally circular top portion denoted generally by the numeral 28 which has an upper surface 21 and a lower surface 22, and a generally cylindrical outer side 23. For engaging the annular channel 14, the upper cap 20 has a conduit 24 which is slightly tapered such that its lower end 25 has a slightly larger diameter than its upper end 26, to facilitate insertion of the rounded tip 15 during assembly. The conduit 24 defines a passage 27, and to assemble the cap to the piston, all that is required is to lower the upper cap 20 over the piston 10 (such that the rounded tip 15 enters passage 27 via lower end 25) and press the cap 20 down onto the piston 10 until annular channel 14 snaps into engagement with conduit 24 to produce the assembly shown in FIG. 4. Edges 16 and 17 are then in contact with lower end 25 and upper end 26, respectively. The upper cap 20 is currently injection molded in one unitary piece from clarified polypropylene.

Figure 4:
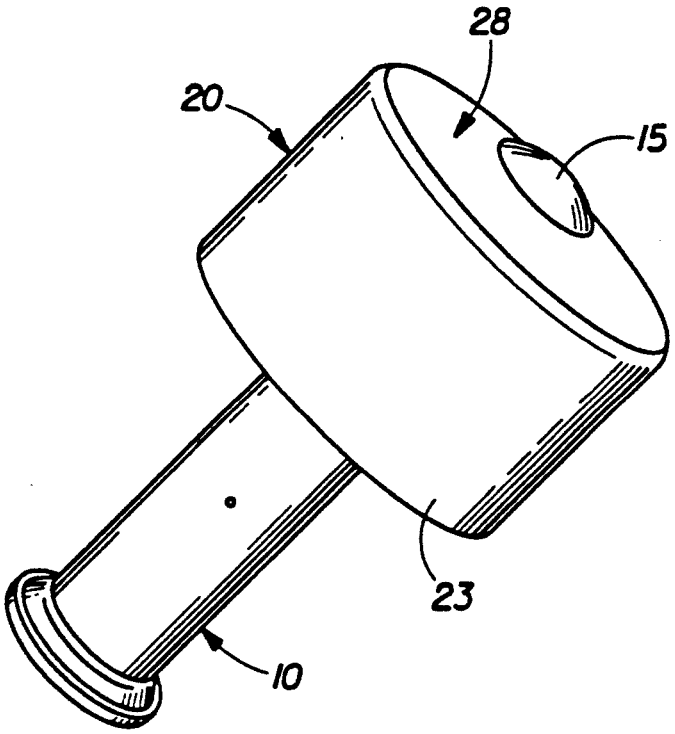
Fig. 4 ( Prior Art )
FIG. 4 is a perspective view of a pump piston assembly according to the prior art.
Figure 5:
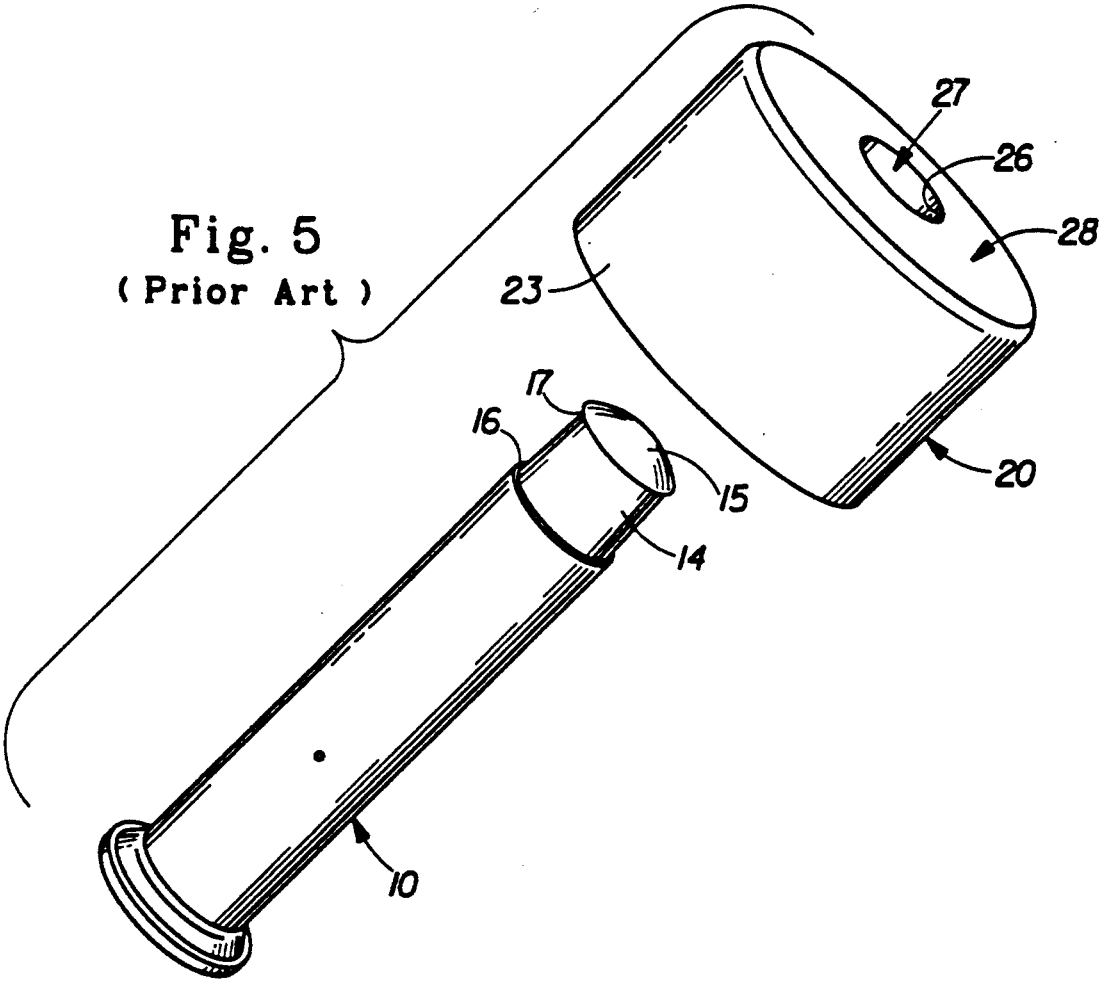
Fig. 5 ( Prior Art )
FIG. 5 is an exploded perspective view of the pump piston assembly of FIG. 4.

FIG. 4 is a perspective view of the pump piston assembly formed in this manner, and FIG. 5 is an exploded perspective view which illustrates the relationship between the pump piston and upper cap as they are brought together during assembly. In one current assembly operation, the containers are filled, after which cylinder assemblies with pump pistons installed are inserted into the container necks and secured by annular collars. The upper caps are then brought down over the top of the piston and driven downward until they snap into place, covering and enclosing the dispensing apparatus for shipment.

Figure 6:
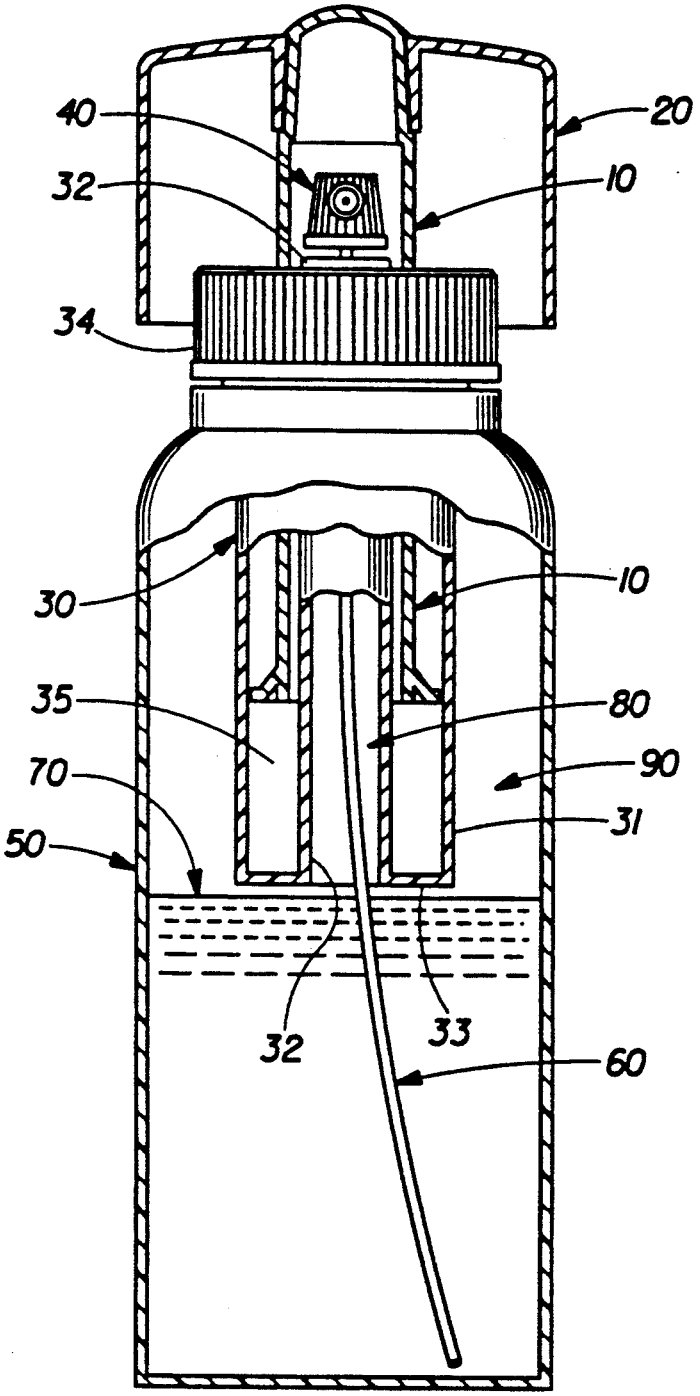
Fig. 6 ( Prior Art )
FIG. 6 is an elevational sectional view of a pump piston assembly, including a pump piston and upper cap, and a container with a cylinder assembly installed (both partially sectioned) according to the prior art.
Figure 7:
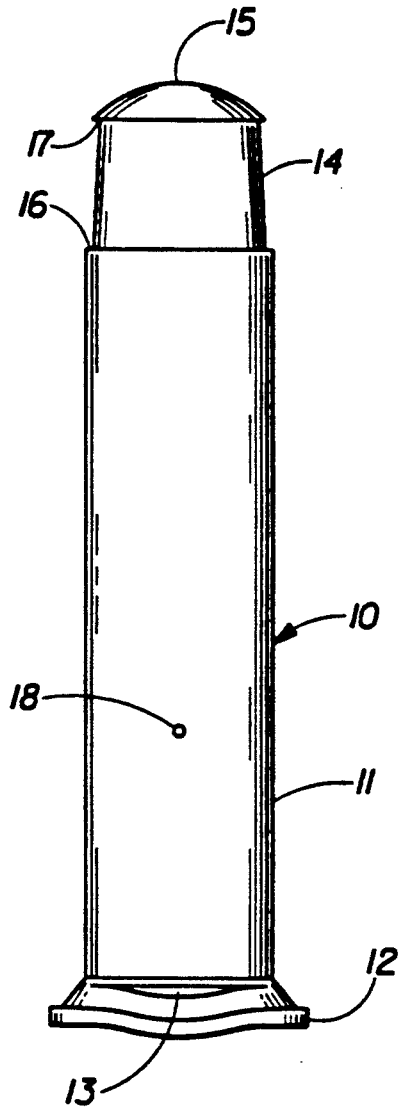
Fig. 7 ( Prior Art )
FIG. 7 is an elevational view of a pump piston according to the prior art, with the inlet valve in the open position.

FIG. 6 also depicts the relationship of the pump piston assembly to the cylinder assembly, denoted generally by the numeral 30. The cylinder assembly includes an inner cylindrical wall 32 and an outer cylindrical wall 31 which are joined by a bottom wall 33 to form an annular pumping chamber 35. The outer wall 31 and the annular seal 12 are in slideable frictional engagement to form an airtight seal. The cylinder assembly further includes a dispensing apparatus denoted generally by the numeral 40 which is supported atop the inner wall 32 and is surrounded by the piston 10 when the piston is inserted into the cylinder assembly. The dispensing apparatus 40 typically includes an actuator button with a spray orifice, a stem, a valve to allow pressurized air to enter the container, a dispensing valve, a spring, and a supply tube 60. The cylinder assembly is secured to a suitable container 50 by an annular collar 34 which is serrated on the outside and threaded on the inside. The outer wall 31 extends upwardly to engage the upper edge of the container neck and serves to secure the entire dispensing apparatus to the container via annular collar 34. The surface 70 of the liquid within the container 50 is preferably below the level of the bottom wall 33, such that the space 80 surrounded by the inner cylindrical wall 32 communicates freely with the rest of the headspace 90 above the liquid surface 70. As such, the liquid level depicted in FIG. 6 would represent a preferred "maximum fill" condition, with the liquid level decreasing during the course of product usage.

FIG. 6 depicts the relationship of the pump piston assembly to the cylinder assembly when the pump piston is in approximately the one-fourth-raised position. As can readily be envisioned from FIG. 6, in the fully-lowered position the lower end of the upper cap contacts the shoulder of the container and the end of the pump piston with the annular seal 12 is nearly in contact with the bottom wall 33. Likewise, in the fully-raised position, the end of the pump piston with the annular seal 12 is adjacent to the top of the outer wall in the vicinity of the annular collar 34.

In operation, to pressurize a container (more precisely, to pressurize the headspace above the liquid in the container) with the prior art apparatus, the consumer draws the pump piston assembly upward with one hand while holding the container/cylinder assembly with the other hand. The frictional contact between the outer wall 31 and annular seal 12 pulls open the inlet valve slit 13 to a position such as that shown in FIG. 7 to admit air into the interior of the piston 10. This opening of the valve slit is due to the inherent flexibility of the piston material. As the annul ar seal 12 nears the top of the outer wall 31, the user reverses the direction of travel and pushes downward on the upper cap 20. The frictional contact between the outer wall 31 and the annular seal 12 now forces the inlet valve slit 13 into a closed, airtight position such as shown in FIG. 1. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

Once the container is initially pressurized, continuous dispensing is possible until the pressure in the container is reduced to the point where the spray pattern is no longer satisfactory. The consumer then re-pressurizes the container as needed throughout the course of dispensing the contents of the container. When the contents of the container are exhausted, the consumer can remove the piston, pumping chamber, and dispensing valve assembly via collar 34, and pour an appropriate amount of liquid product (less than the amount needed to reach the lower surface of the bottom wall 33, as discussed above) into the container to refill and reuse the existing container. Upon reassembly, the consumer can then re-pressurize the container and again dispense the desired product.

To dispense liquid product from the dispensing apparatus 40, the pump piston assembly must be entirely removed by sliding the piston 10 up and out of engagement with the outer wall 31. The actuator button can then be depressed in conventional fashion to open the dispensing valve and dispense liquid product, which is forced up through the supply tube by the pressure within the container. Likewise, to store the container with the pump piston in place and in a lowered position, the piston assembly can be lowered by pushing down slowly on the upper cap 20 until the upper cap 20 bottoms out on the surface of the container 50. During this lowering operation, the bleed hole 18 will allow residual air pressure to escape from the interior of the piston to prevent the piston assembly from rising again due to the force of the compressed air.

In "lost motion" devices, in particular valve arrangements utilizing the principles of lost motion, two components defining a valve opening move relative to one another to open and close the valve. As applied to the present invention, the upper cap and the piston itself are connected in such a manner that a range of motion in one direction is permitted. Thus, the upper cap can move downward on the piston to a certain defined limit, at which point the cap and piston move downward as a unit. Likewise, the upper cap can move upward on the piston to a certain defined limit, at which point the cap and piston move upward as a unit. The "lost" motion can be thus defined as the motion of the cap relative to the piston in one direction or the other before which the piston likewise begins its travel along with the cap.

It is to be understood that all embodiments and variants of the present invention are suitable for and intended for use with the prior art cylinder assembly, dispensing apparatus, and container. As such, the cylinder assembly, dispensing apparatus, and container are omitted from FIGS. 8–22 in the interest of clarity since the relationship of the pump piston assembly to these items in the present invention is precisely as that exemplified by the prior art.

Figure 8:
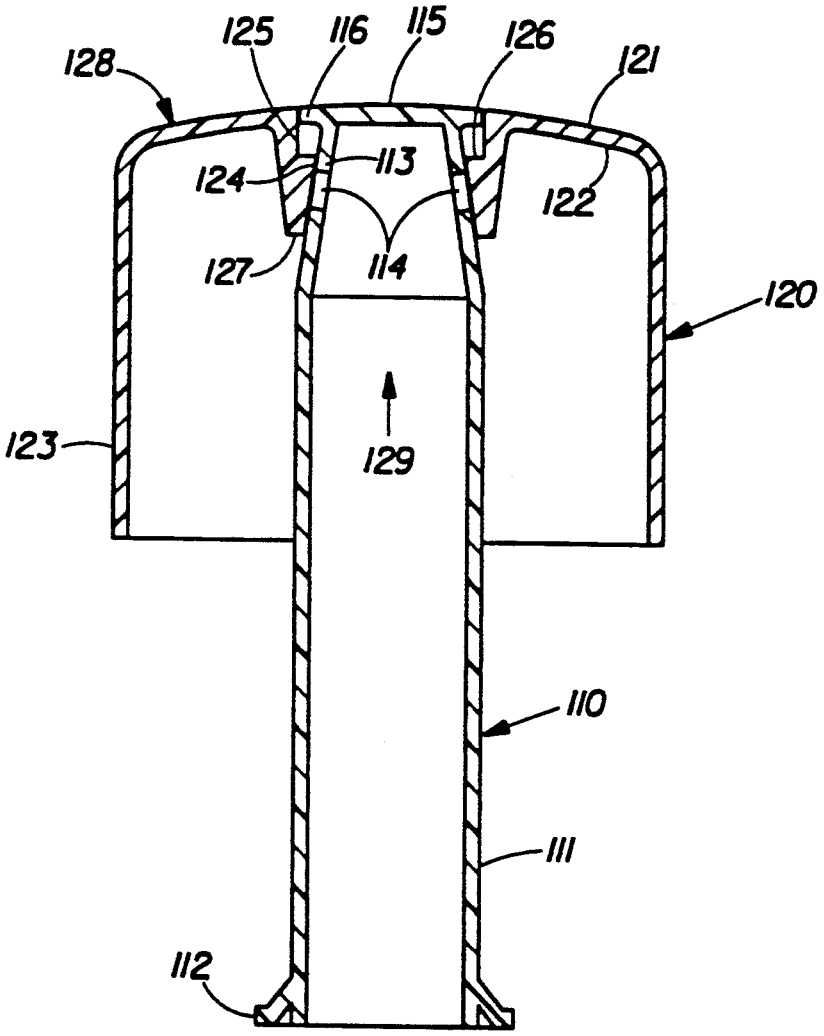
FIG. 8 is an elevational sectional view of a first embodiment of the present invention, with the inlet valve in the closed position.

Referring now to FIG. 8, an elevational sectional view of a first embodiment of the present invention is depicted. The tubular pump piston, referred to generally by the numeral 110, includes a cylindrical outer wall Ill with an annular seal 112 at one end and a closed top portion 115 at the other end. The outer wall 111 has a tapered shoulder 113 extending around the periphery of the piston 110 near the closed top portion 115 for engaging the upper cap, generally denoted by the numeral 120, in a manner to be described below. The closed top portion has an annular retaining lip 116 which projects beyond the upper end of tapered shoulder 113. The tapered shoulder 113 includes at least one aperture 114 extending through the piston wall, and preferably includes at least two such apertures 114 equally spaced around the periphery of the pump piston 110.

The upper cap 120 has a generally circular top portion denoted generally by the numeral 128 which has an upper surface 121 and a lower surface 122, and a generally cylindrical outer side 123. For engaging the tapered shoulder 113, the upper cap 120 has a tapered conduit 124 which has a lower end 127 and an upper end 126. The upper end 126 has a smaller diameter than the lower end 127, and the taper of the conduit 124 matches the taper of the tapered shoulder 113. The cap further includes an annular sidewall 125 which defines the upper end 126 of tapered conduit 124 and provides a stop for the retaining lip 116. The tapered conduit defines a passage 129, and to assemble the cap to the piston, all that is required is to lower the upper cap 120 over the piston 110 (such that the closed top portion 115 enters passage 129 via lower end 127) and press the cap 120 down onto the piston 110 until the retaining lip 116 snaps beyond the upper end 126 of tapered conduit 124 to produce the assembly shown in FIG. 8.

Figure 9:
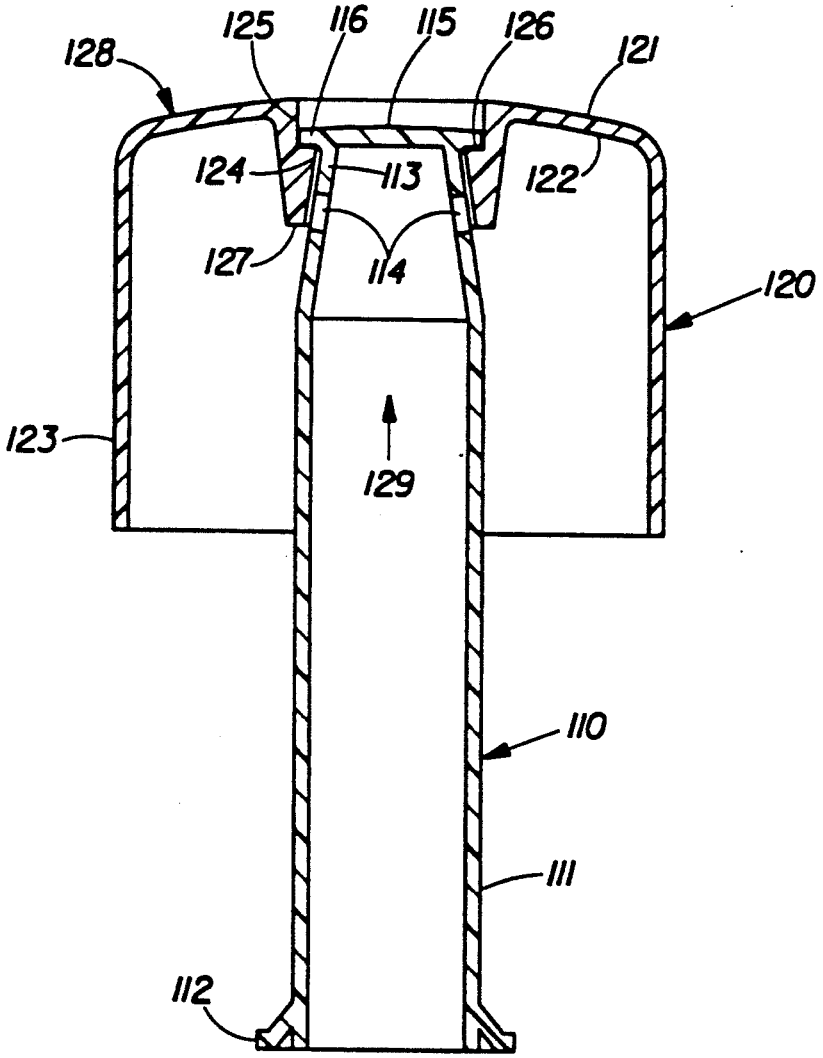
FIG. 9 is an elevational sectional view of the pump piston of FIG. 8, with the inlet valve in the open position.

The longitudinal distance between the retaining lip 116 and the bottom of the tapered shoulder 113 is greater than the longitudinal distance between the upper end 126 and the lower end 127 of the tapered conduit, so as to permit a range of relative motion between the pump piston 110 and the upper cap 120. At one limit of the range of motion, as shown in FIG. 8, the tapered conduit 124 is wedged tightly onto the tapered shoulder 113 so as to tightly seal the apertures 114. At the other limit of the range of motion, as shown in FIG. 9, the retaining lip 116 engages the upper end 126 of tapered conduit 124 to prevent the upper cap 120 from separating from the pump piston 110, and the tapered shoulder 113 and tapered conduit 124 are slightly spaced apart so as to permit air to enter the interior of the pump piston 110 via the apertures 114. The range of relative motion between the pump piston 110 and upper cap 120, which also dictates the degree of separation between the tapered shoulder 113 and tapered conduit 124, is preferably between 0.010 inches (0.254 mm) and 0.100 inches (2.54 mm), and most preferably is about 0.030 inches (0.762 mm). These dimensions have resulted in a pump piston assembly that performs well, based on the approximate size of the prior art piston assembly. When applied to other pump piston assemblies of differing materials and/or overall dimensions, these dimensions may need to be adjusted to achieve best results.

In operation, to pressurize a container with a pump piston assembly according to this embodiment, the consumer draws the pump piston assembly upward with one hand while holding the container/cylinder assembly with the other hand. The frictional contact between the outer wall (denoted by the numeral 31 in FIG. 6) and annular seal 112 causes the pump piston 110 to lag behind the upper cap 120 until the retaining lip 116 engages the upper end 126 of tapered conduit 124, at which point the two components move upward together. The apertures 114 then permit air to be admitted into the interior of the piston 110 as shown in FIG. 9. As the annular seal 112 nears the top of the outer wall, the user reverses the direction of travel and pushes downward on the upper cap 120. The frictional contact between the outer wall and the annular seal 112 now forces the inlet valve (tapered conduit 124 and tapered shoulder 113) into a closed, airtight position such as shown in FIG. 8. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

To dispense liquid product from the dispensing apparatus (denoted by the numeral 40 in FIG. 6), the pump piston assembly must be entirely removed by sliding the piston 110 up and out of engagement with the outer wall. The actuator button can then be depressed in conventional fashion to open the dispensing valve and dispense liquid product, which is forced up through the supply tube by the pressure within the container. Likewise, to store the container with the pump piston in place and in a lowered position, the piston assembly can be lowered by pushing down slowly on the upper cap 120 until the upper cap 120 bottoms out on the surface of the container. If desired, to facilitate the lowering of the pump piston and the venting of residual air pressure, a small bleed hold such as that utilized in the prior art (see FIGS. 1–7) may be included in the piston wall to prevent the piston assembly from rising again due to the force of the compressed air.

As a possible modification of this embodiment, the annular sidewall can be eliminated and the edge formed by the union of the upper end 126 and the top portion 128 could serve to engage the retaining lip 116 of the piston. Other possible modifications may include variations in the number, size, and locations of the apertures, so long as they remain located in regions of the tapered shoulder which interact with the conduit such that they can be sealed when the tapered shoulder and conduit are tightly engaged.

Another possible modification of this embodiment would be to utilize a piston formed according to the prior art (but without the inlet valve slit near the annular seal) and to cut the inlet apertures in the slightly tapered annular channel depicted in FIG. 1. A prior art upper cap, with a portion of the lower end of the conduit removed in an amount equal to the amount of lost motion desired, could then be utilized with the modified piston. In this fashion, a minimal amount of production change would be required in order to achieve the advantages of this embodiment of the present invention.

Figure 10:
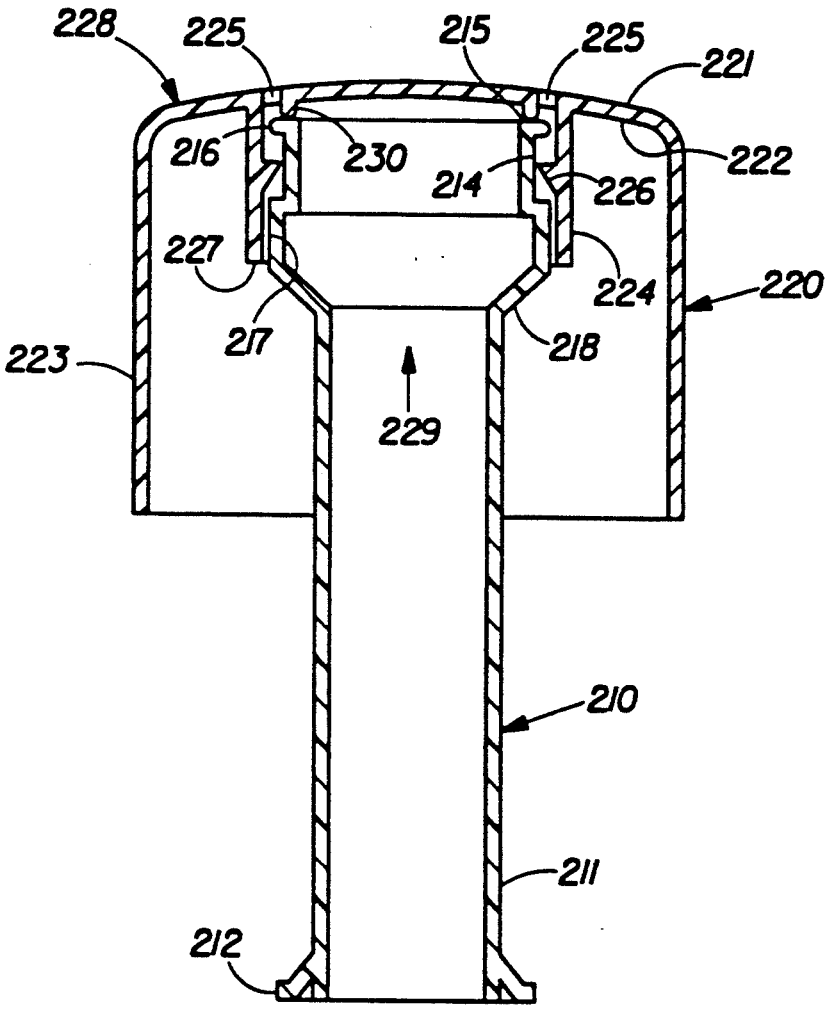
FIG. 10 is an elevational sectional view of a second embodiment of the present invention, with the inlet valve in the closed position.
Figure 11:
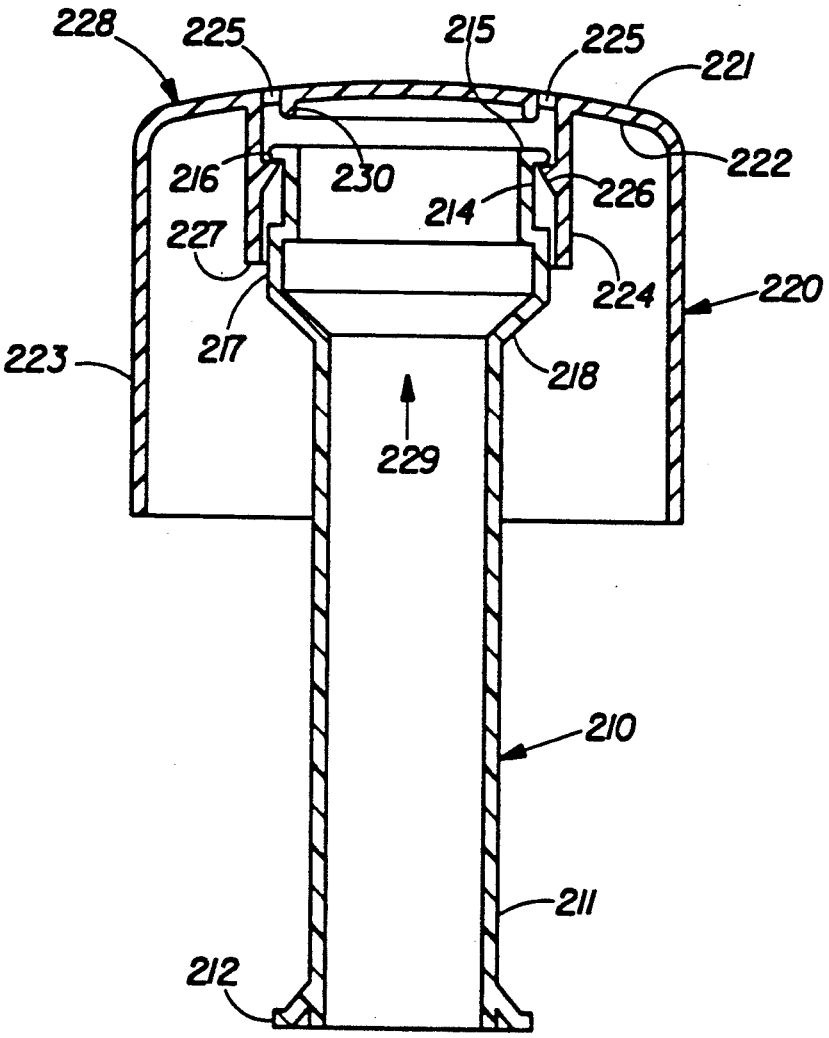
FIG. 11 is an elevational sectional view of the pump piston of FIG. 10, with the inlet valve in the open position.

A second embodiment of the present invention is depicted in FIGS. 10 and 11, both of which are elevational sectional views. The tubular pump piston, referred to generally by the numeral 210, is open at both ends and includes a cylindrical outer wall 211. The outer wall 211 has an annular seal 212 at one end and a sealing surface 215 at the other end. The outer wall 211 also has an annular channel 214 and an outer edge 216 extending around the periphery of the piston 210 for engaging the upper cap, generally denoted by the numeral 220, in a manner to be described below. The piston also includes a guide portion 217 which helps to maintain the alignment between the piston 210 and upper cap 220, and a flared portion 218 which permits differing diameters to be used for the upper and lower portions of the piston, for reasons to be discussed below.

Figure 12:
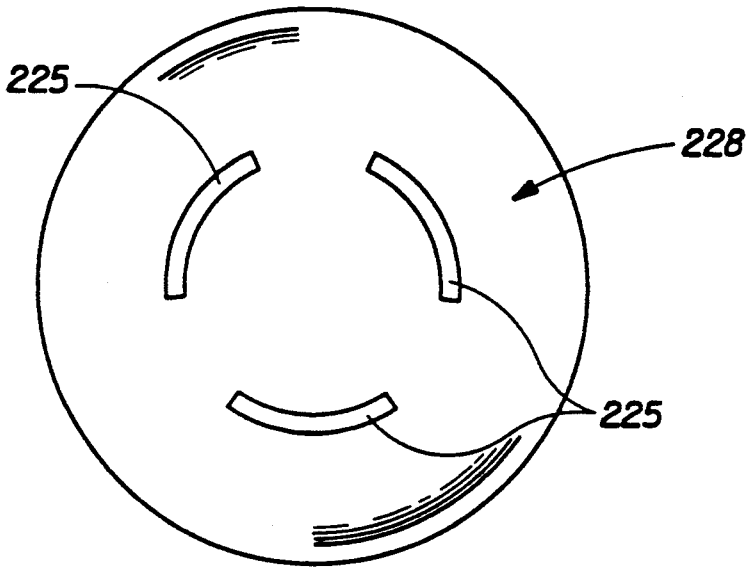
FIG. 12 is a top plan view of the pump piston assembly of FIG. 10.

The upper cap 220 has a generally circular top portion denoted generally by the numeral 228 which has an upper surface 221 and a lower surface 222, and a generally cylindrical outer side 223. For engaging the outer edge 216, the upper cap 220 has a tubular conduit 224 which has an open lower end 227 and an annular retaining ring 226. This annular retaining ring 226 can be a complete annular ring, or a plurality of segments of such an annular ring equally spaced around the periphery of the piston. Most preferably, the annular ring comprises three or more segments of such a ring, to facilitate molding of the upper cap. The upper cap 220 also includes at least one aperture 225, and preferably three or more such apertures whose size and locations coincide in overlying relation with the size and locations of annular ring segments 226. A portion of the upper mold piece projects through and forms the apertures 225 and defines the upper edge of the corresponding segments 226 during the injection molding process. FIG. 12 is a plan view of the pump piston assembly, and clearly depicts one possible configuration of apertures. In addition to facilitating the molding of the segments 226, these apertures also function as air inlets to admit air into the interior of the piston due to their location radially outward of the sealing surface but inward of the tubular conduit.

The upper cap 220 also includes an annular sealing ring 230 which is sized and disposed to engage sealing surface 215 to form an airtight seal. The tubular conduit defines a passage 229, and to assemble the cap to the piston, all that is required is to lower the upper cap 220 over the piston 210 (such that the sealing surface 215 enters passage 229 via lower end 227) and press the cap 220 down onto the piston 210 until the outer edge 216 snaps beyond the retaining ring or segments 226 to product the assembly shown in FIG. 10. A presently preferred arrangement is a sealing ring with a semi-circular cross section and a sealing surface which is perpendicular to the longitudinal axis of the pump piston.

The longitudinal distance between the sealing ring 230 and the retaining ring 226 is greater than the thickness of the end of the piston in the vicinity of outer edge 216 and sealing surface 215, so as to permit a range of relative motion between the pump piston 210 and the upper cap 220. At one limit of the range of motion, as shown in FIG. 10, the sealing ring 230 is tightly engaging sealing surface 215 so as to tightly seal the piston 210 to the upper cap 220 and cut off any air flow from the apertures 225. At the other limit of the range of motion, as shown in FIG. 11, the retaining ring or segments 226 engage the outer edge 216 of the piston to prevent the upper cap 220 from separating from the pump piston 210, and in this position the sealing ring 230 and sealing surface 215 are slightly spaced apart so as to permit air to enter the interior of the pump piston 210 via the apertures 225. The range of relative motion between the pump piston 210 and upper cap 220, which also dictates the degree of separation between the sealing ring 230 and sealing surface 215, is preferably between 0.010 inches (0.254 Mm) and 0.100 inches (2.54 mm), and most preferably is about 0.030 inches (0.762 mm). These dimensions have resulted in a pump piston assembly that performs well, based on the approximate size of the prior art piston assembly. When applied to other pump piston assemblies of differing materials and/or overall dimensions, these dimensions may need to be adjusted to achieve best results.

In operation, to pressurize a container with a pump piston assembly according to this embodiment, the consumer draws the pump piston assembly upward with one hand while holding the container/cylinder assembly with the other hand. The frictional contact between the outer wall (denoted by the numeral 31 in FIG. 6) and annular seal 212 causes the pump piston 210 to lag behind the upper cap 220 until the outer edge 216 engages the retaining ring or segments 226, at which point the two components move upward together. The apertures 225 then permit air to be admitted into the interior of the piston 210 as shown in FIG. 11. As the annular seal 212 nears the top of the outer wall , the user reverses the direction of travel and pushes downward on the upper cap 220. The frictional contact between the outer wall and the annular seal 212 now forces the inlet valve (sealing ring 230 and sealing surface 215) into a closed, airtight position such as shown in FIG. 10. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

To dispense liquid product from the dispensing apparatus (denoted by the numeral 40 in FIG. 6), the pump piston assembly must be entirely removed by sliding the piston 210 up and out of engagement with the outer wall. The actuator button can then be depressed in conventional fashion to open the dispensing valve and dispense liquid product, which is forced up through the supply tube by the pressure within the container. Likewise, to store the container with the pump piston in place and in a lowered position, the piston assembly can be lowered by pushing down slowly on the upper cap 220 until the upper cap 220 bottoms out on the surface of the container. Any pressure remaining at the bottom of the stroke would push upward on the central portion of the underside of the upper cap so as to raise the upper cap 220 slightly and thus slightly separate the sealing ring 230 and sealing surface 215 to allow the air to escape.

If desired, to facilitate the lowering of the pump piston and the venting of residual air pressure, a small bleed hold such as that utilized in the prior art (see FIGS. 1–7) may be included in the piston wall to prevent the piston assembly from rising again due to the force of the compressed air. If, however, the area of the lower surface of the upper cap bounded by the sealing ring is approximately the same as the projected area of the end of the piston with the annular seal, the residual pressure should lift the upper cap to vent the pressure without raising the pump piston assembly. As such, in this configuration the bleed hole would be unnecessary, and for this reason these areas are preferably about equal, as depicted in FIGS. 10 and 11. Flared portion 218 accomplishes the change in piston diameter required to achieve this area relationship. If, however, the piston is desired to be of a generally uniform diameter and other venting means utilized, guide portion 217 and the lower portion of the piston wall can be of the same diameter and flared portion 218 can be omitted.

According to this embodiment of the present invention, the number, size, and location of the apertures and segments may be varied, so long as their relationship to the sealing ring and sealing surface is as described above. Additionally, the sealing ring may be of any desired cross section, such as semi-circular, rectangular, or triangular, and the sealing surface may have any desired profile, such as rounded, beveled, or tapered. The sealing ring and sealing surface may also have complementary or interacting cross-sectional shapes such as V-shapes and concave and convex surfaces, as well as abutting shapes such as bevels and convex surfaces.

As a further modification, if a closer fit between the inner surface of tubular conduit 224 and guide portion 217 is desired, a series of longitudinal ribs (not shown) could be added to the inner surface of the tubular conduit 224 to decrease the gap between the components without significantly increasing friction.

FIGS. 13–22 display various versions of a third embodiment of the present invention. All versions of this embodiment are suitable for and are intended to be used with an upper cap according to the prior art, such as depicted in FIGS. 2–6, as well as the prior art cylinder assembly, dispensing apparatus, and container. As such, the upper cap, cylinder assembly, dispensing apparatus, and container are omitted in the interest of clarity since the relationship of the pump piston assembly to these items in the present invention is precisely as that exemplified by the prior art.

In the pump piston assembly according to this third embodiment, a plurality of inlet valve slits in the wall of the pump piston are employed. These inlet valve slits are located remotely from the annular seal at the lower end of the pump piston so as to be protected from contamination by any liquid product residue on the outer wall and in the lower portion of the annular chamber. The inlet valve slits in all versions of this embodiment are preferably located as near to the upper cap and as far from the annular seal as practicable, preferably within the upper two-thirds of the distance between the annular seal and the annular channel, more preferably within the upper one-half of this distance, and most preferably within the upper quarter of this distance. While a potentially infinite number of versions of this embodiment are possible, including any plural number of slits, what follows is a detailed description of a presently preferred version of this embodiment and four other versions.

Figure 13:
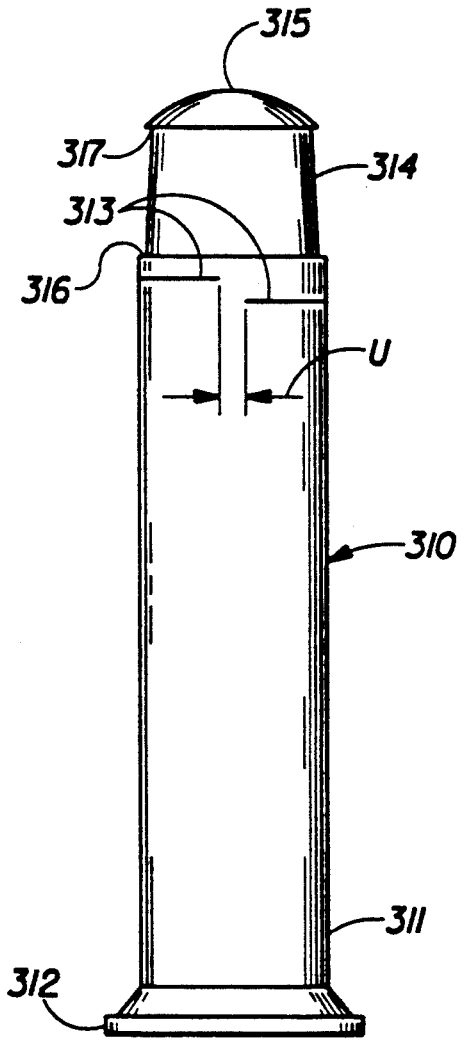
FIG. 13 is an elevational view of a presently preferred version of a third embodiment of the present invention, with the inlet valve in the closed position.

Referring now to FIG. 13, an elevational view of a presently preferred version of the third embodiment is depicted, with the numeral 310 referring generally to the pump piston. The pump piston 310 includes a cylindrical outer wall 311 with an annular seal 312 at one end and a rounded tip 315 at the other end. The outer wall 311 has an annular channel 314 which extends around the periphery of the piston 310 in the vicinity of the rounded tip 315 for engaging the upper cap, generally denoted by the numeral 20 in FIGS. 2–6, in the manner previously described.

As shown in FIG. 13, the inlet valve according to this preferred version of the third embodiment comprises a pair of diametrically opposed inlet valve slits 313 in the piston wall 311, near the annular channel 314. Each inlet valve slit 313 preferably extends over somewhat less than 180 degrees of the piston surface, such that the ends of the slits are spaced apart circumferentially with respect to the piston. This defines what may be called an "underlap" (as opposed to an "overlap"), which is shown in FIG. 13 as the dimension "U". This underlap is also subject to variation, but preferably is between about zero and about ¼ inches (0–6.4 mm), and most preferably is approximately 3/32 inches (2.4 Mm). To maintain the necessary structural integrity of the piston 310, the slits are also preferably spaced apart longitudinally (axially) with respect to the piston. This spacing is preferably between about ⅛ and about ⅜ inches (3.2–9.6 mm), and most preferably is approximately 3/16 inches (4.8 mm).

These dimensions have resulted in a pump piston assembly that performs well, based on the approximate size of the prior art piston assembly. When applied to other pump piston assemblies of differing materials and/or overall dimensions, the slit dimensions may need to be adjusted to achieve best results. Slits of equal length are preferred in order to exert symmetrical forces on the piston and maintain a concentric alignment with the outer wall of the cylinder assembly during the raising and lowering process, although slits of unequal length (particularly small deviations) may perform acceptably.

In operation, to pressurize a container with a pump piston assembly according to this version of the third embodiment, the consumer draws the pump piston assembly upward with one hand while holding the container/cylinder assembly with the other hand. The frictional contact between the outer wall (denoted by the numeral 31 in FIG. 6) and annular seal 312 pulls open the inlet valve slits 313 to a position such as that shown in FIG. 14 to admit air into the interior of the piston 310. This opening of the valve slits is due to the inherent flexibility of the piston material. As the annular seal 312 nears the top of the outer wall, the user reverses the direction of travel and pushes downward on the upper cap. The frictional contact between the outer wall and the annular seal 312 now forces the inlet valve slits 313 into a closed, airtight position such as shown in FIG. 13. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

To dispense liquid product from the dispensing apparatus (denoted by the numeral 40 in FIG. 6), the pump piston assembly must be entirely removed by sliding the piston 310 up and out of engagement with the outer wall. The actuator button can then be depressed in conventional fashion to open the dispensing valve and dispense liquid product, which is forced up through the supply tube by the pressure within the container. Likewise, to store the container with the pump piston in place and in a lowered position, the piston assembly can be lowered by pushing down slowly on the upper cap until the upper cap bottoms out on the surface of the container. If desired, to facilitate the lowering of the pump piston and the venting of residual air pressure, a small bleed hold such as that utilized in the prior art (see FIGS. 1–7) may be included in the piston wall to prevent the piston assembly from rising again due to the force of the compressed air.

Figure 15:
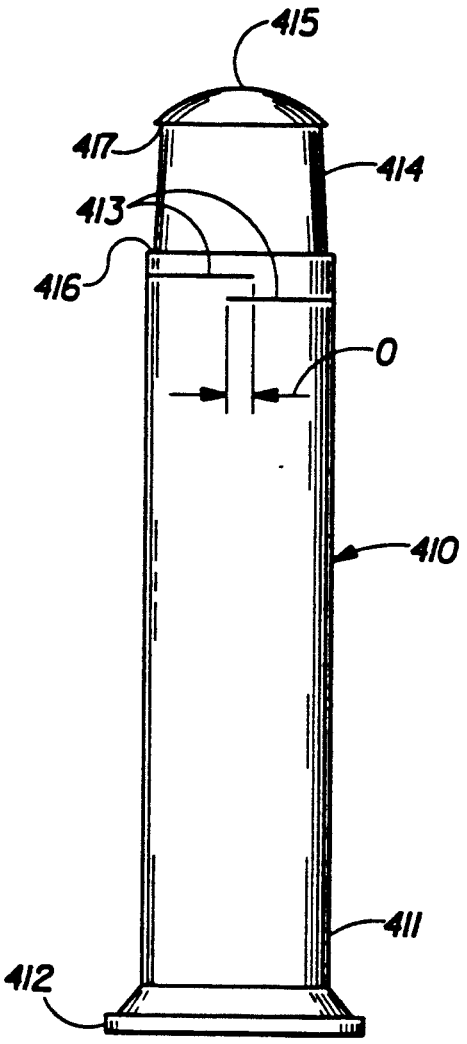
FIG. 15 is an elevational view of another version of a third embodiment of the present invention, with the inlet valve in the closed position.
Figure 16:
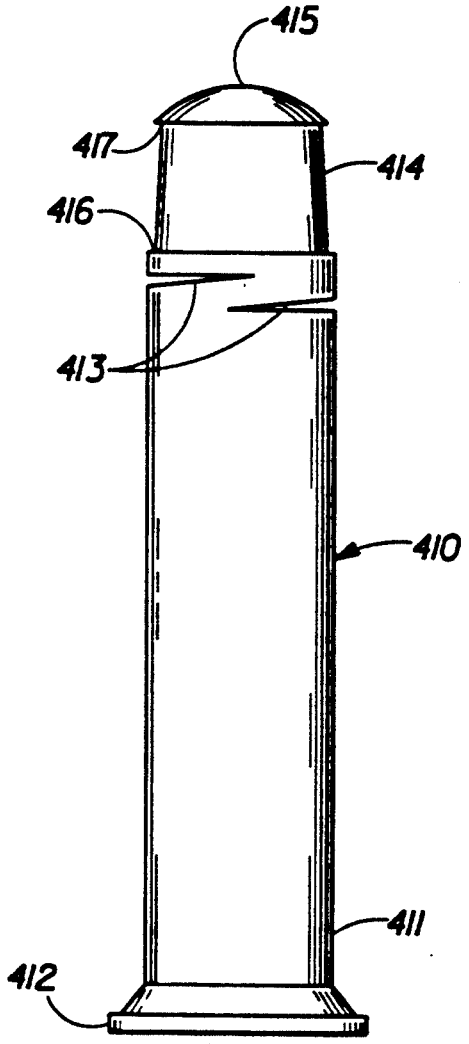
FIG. 16 is an elevational view of the pump piston of FIG. 15, with the inlet valve in the open position.

Another version of the third embodiment is depicted in FIGS. 15 and 16. FIG. 15 presents an elevational view of the pump piston, referred to generally by the numeral 410. The pump piston 410 includes a cylindrical outer wall 411 with an annular seal 412 at one end and a rounded tip 415 at the other end. The outer wall 411 has an annular channel 414 which extends around the periphery of the piston 410 in the vicinity of the rounded tip 415 for engaging the upper cap, generally denoted by the numeral 20 in FIGS. 2–6, in the manner previously described.

Figure 17:
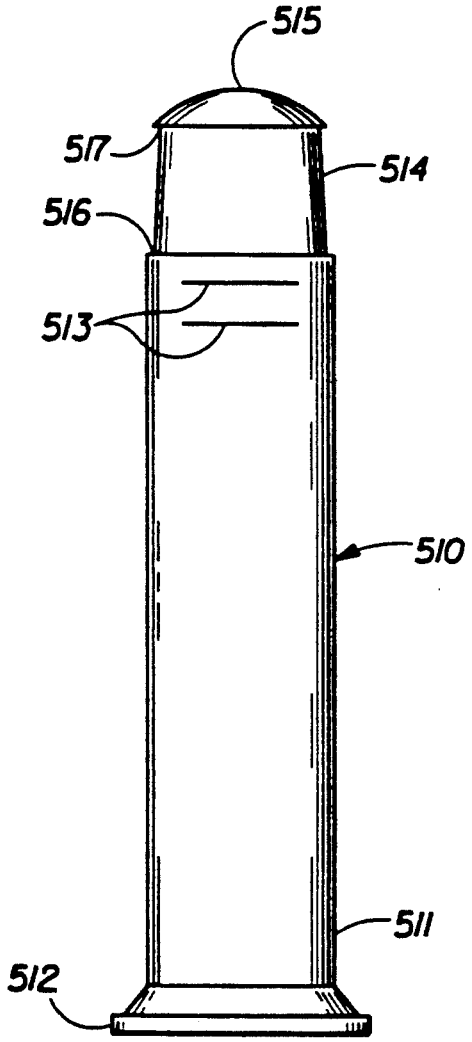
FIG. 17 is an elevational view of another version of a third embodiment of the present invention, with the inlet valve in the closed position.

As shown in FIG. 15, the inlet valve according to this version of the third embodiment comprises a pair of diametrically opposed inlet valve slits 413 in the piston wall 411, near the annular channel 414. Each inlet valve slit 413 preferably extends over somewhat more than 180 degrees of the piston surface, such that the slits overlap at both ends circumferentially with respect to the piston. This overlap is depicted in FIG. 17 as the dimension "0". This overlap is also subject to variation, but preferably is between about zero and about ⅛ inches (0–3.2 mm), and most preferably is approximately 1/16 inches (1.6 mm). To maintain the necessary structural integrity of the piston 410, the slits are also preferably spaced apart longitudinally (axially) with respect to the piston. This spacing is preferably between about ⅛ and about ⅜ inches (3.2–9.6 mm), and most preferably is approximately ¼ inches (6.4 mm).

These dimensions have resulted in a pump piston assembly that performs well, based on the approximate size of the prior art piston assembly. When applied to other pump piston assemblies of differing materials and/or overall dimensions, the slit dimensions may need to be adjusted to achieve best results. Slits of equal length are preferred in order to exert symmetrical forces on the piston and maintain a concentric alignment with the outer wall of the cylinder assembly during the raising and lowering process, although slits of unequal length (particularly small deviations) may perform acceptably.

In operation, to pressurize a container with a pump piston assembly according to this version of the third embodiment, the consumer draws the pump piston assembly upward with one hand while holding the container/cylinder assembly with the other hand. The frictional contact between the outer wall (denoted by the numeral 31 in FIG. 6) and annular seal 412 pulls open the inlet valve slits 413 to a position such as that shown in FIG. 16 to admit air into the interior of the piston 410. This opening of the valve slits is due to the inherent flexibility of the piston material. As the annular seal 412 nears the top of the outer wall, the user reverses the direction of travel and pushes downward on the upper cap. The frictional contact between the outer wall and the annular seal 412 now forces the inlet valve slits 413 into a closed, airtight position such as shown in FIG. 15. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

Figure 14:
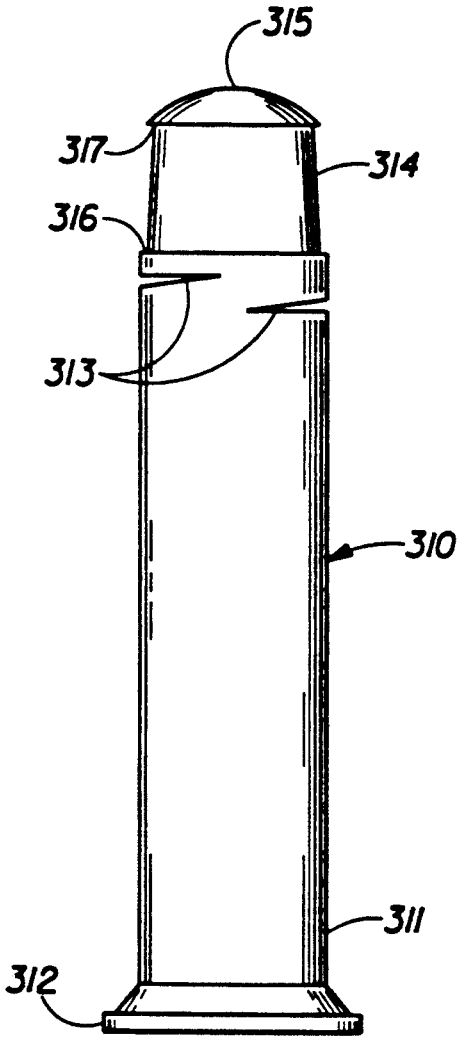
FIG. 14 is an elevational view of the pump piston of FIG. 13, with the inlet valve in the open position.

The dispensing and storage operations utilizing a pump piston according to this version of the third embodiment are precisely the same as those described with respect to the version of FIGS. 13 and 14.

Figure 18:
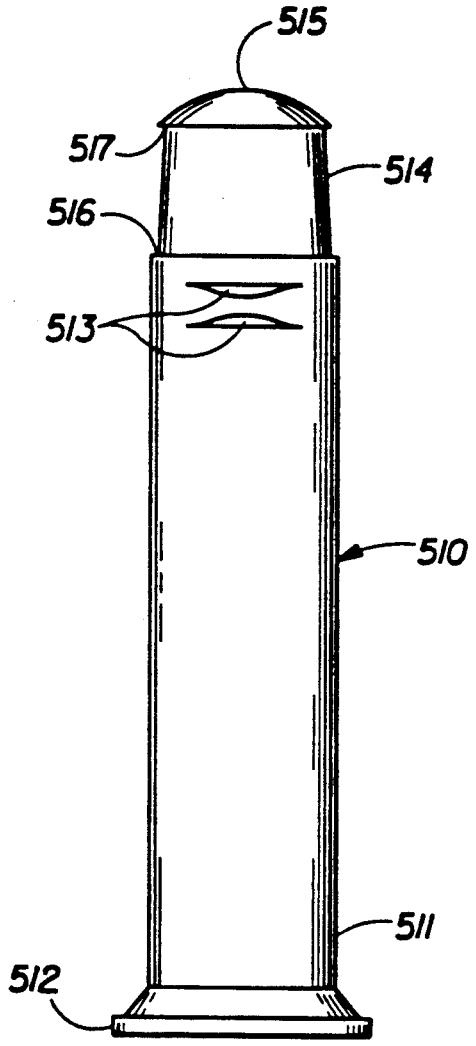
FIG. 18 is an elevational view of the pump piston of FIG. 17, with the inlet valve in the open position.

Another version of the third embodiment is depicted in FIGS. 17 and 18. FIG. 17 presents an elevational view of the pump piston, referred to generally by the numeral 510. The pump piston 510 includes a cylindrical outer wall 511 with an annular seal 512 at one end and a rounded tip 515 at the other end. The outer wall 511 has an annular channel 514 which extends around the periphery of the piston 510 in the vicinity of the rounded tip 515 for engaging the upper cap, generally denoted by the numeral 20 in FIGS. 2–6, in the manner previously described.

As shown in FIG. 17, the inlet valve according to this version of the third embodiment comprises a pair of vertically superimposed inlet valve slits 513 in the piston wall 511, near the annular channel 514. The two inlet valve slits 513 preferably have equal lengths and are centered over one another. The slits 513 preferably extend over approximately 128 degrees of the piston surface, in order to maintain the structural integrity of the piston while permitting the required valving action. Given the approximate size of the prior art piston, this results in slits which are approximately ¾ inches (19 mm) long. To maintain the necessary structural integrity of the piston 510, the slits are also spaced apart longitudinally (axially), preferably approximately ⅛ inches (3.2 mm).

These dimensions have resulted in a pump piston assembly that performs well, based on the approximate size of the prior art piston assembly. When applied to other pump piston assemblies of differing materials and/or overall dimensions, the slit dimensions may need to be adjusted to achieve best results. While the illustrations depict slits of equal length, slits of unequal length (particularly small deviations) may perform acceptably.

In operation, to pressurize a container with a pump piston assembly according to this version of the third embodiment, the consumer draws the pump piston assembly upward with one hand while holding the container/cylinder assembly with the other hand. The frictional contact between the outer wall (denoted by the numeral 31 in FIG. 6) and annular seal 512 pulls open the inlet valve slits 513 to a position such as that shown in FIG. 18 to admit air into the interior of the piston 510. This opening of the valve slits is due to the inherent flexibility of the piston material. As the annular seal 512 nears the top of the outer wall, the user reverses the direction of travel and pushes downward on the upper cap. The frictional contact between the outer wall and the annular seal 512 now forces the inlet valve slits 513 into a closed, airtight position such as shown in FIG. 17. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

The dispensing and storage operations utilizing a pump piston according to this version of the third embodiment are precisely the same as those described with respect to the version of FIGS. 13 and 14.

Figure 19:
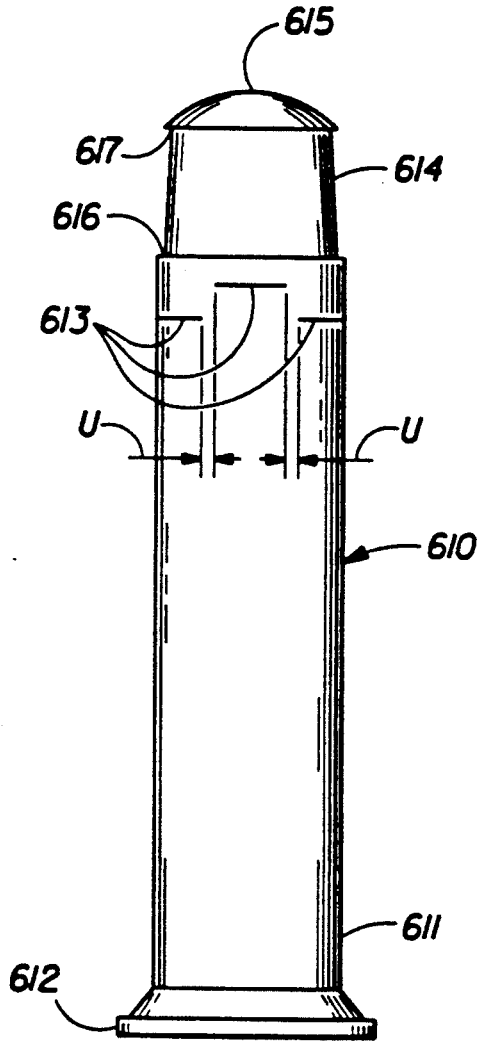
FIG. 19 is an elevational view of another version of a third embodiment of the present invention, with the inlet valve in the closed position.
Figure 20:
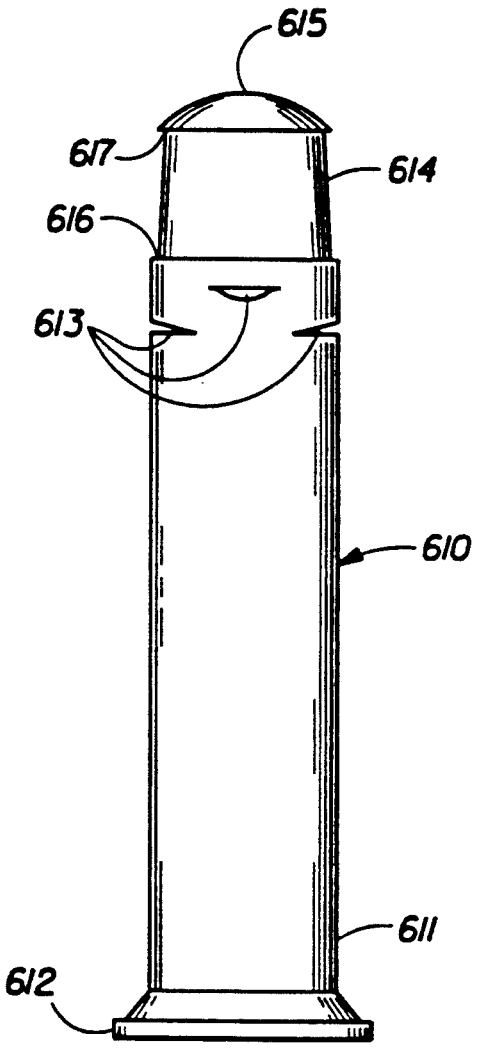
FIG. 20 is an elevational view of the pump piston of FIG. 19, with the inlet valve in the open position.

Another version of the third embodiment is depicted in FIGS. 19 and 20. FIG. 19 presents an elevational view of the pump piston, referred to generally by the numeral 610. The pump piston 610 includes a cylindrical outer wall 611 with an annular seal 612 at one end and a rounded tip 615 at the other end. The outer wall 611 has an annular channel 614 which extends around the periphery of the piston 610 in the vicinity of the rounded tip 615 for engaging the upper cap, generally denoted by the numeral 20 in FIGS. 2-6, in the manner previously described.

As shown in FIG. 19, the inlet valve according to this version of the third embodiment comprises three inlet valve slits 613 on one side of the piston wall 611, near the annular channel 614. The three inlet valve slits 613 preferably have equal lengths and are arranged such that the lower two slits are spaced apart circumferentially a distance slightly greater than the length of the upper slit. In this fashion, the ends of the upper slit and the adjacent ends of the lower slits are spaced apart circumferentially (similar to the valve slits depicted in FIGS. 13 and 14). This likewise defines an "underlap", which is shown in FIG. 19 as the dimension "U". The slits 613 preferably extend over approximately 234 degrees of the piston surface, in order to maintain the structural integrity of the piston while permitting the required valving action. Given the approximate size of the prior art piston, this results in slits which are approximately ½ inches (12.7 Mm) long. This underlap is also subject to variation, but preferably is between about zero and about ¼ inches (0–6.4 Mm), and most preferably is approximately 3/32 inches (2.4 mm). To maintain the necessary structural integrity of the piston 610, the slits are also preferably spaced apart longitudinally (axially) with respect to the piston. This spacing is preferably between about 1/16 and about ⅜ inches (1.6–9.6 mm), and most preferably is approximately 1/16 inches (1.6 mm).

These dimensions have resulted in a pump piston assembly that performs well, based on the approximate size of the prior art piston assembly. When applied to other pump piston assemblies of differing materials and/or overall dimensions, the slit dimensions may need to be adjusted to achieve best results. While the illustrations depict slits of equal length, slits of unequal length (particularly small deviations) may perform acceptably.

In operation, to pressurize a container with a pump piston assembly according to this version of the third embodiment, the consumer draws the pump piston assembly upward with one hand while holding the container/cylinder assembly with the other hand. The frictional contact between the outer wall (denoted by the numeral 31 in FIG. 6) and annular seal 612 pulls open the inlet valve slits 613 to a position such as that shown in FIG. 20 to admit air into the interior of the piston 610. This opening of the valve slits is due to the inherent flexibility of the piston material. As the annular seal 612 nears the top of the outer wall, the user reverses the direction of travel and pushes downward on the upper cap. The frictional contact between the outer wall and the annular seal 612 now forces the inlet valve slits 613 into a closed, airtight position such as shown in FIG. 19. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

The dispensing and storage operations utilizing a pump piston according to this version of the third embodiment are precisely the same as those described with respect to the version of FIGS. 13 and 14.

Figure 21:
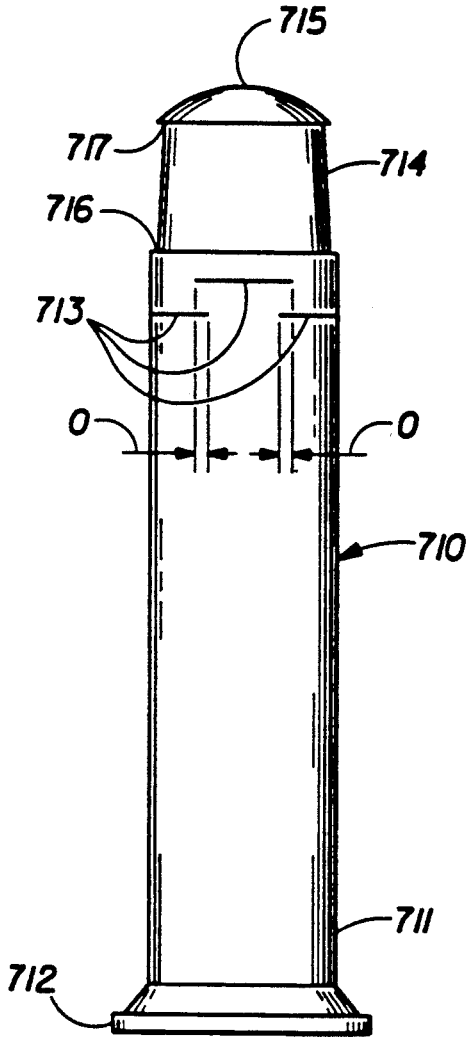
FIG. 21 is an elevational view of yet another version of a third embodiment of the present invention, with the inlet valve in the closed position.
Figure 22:
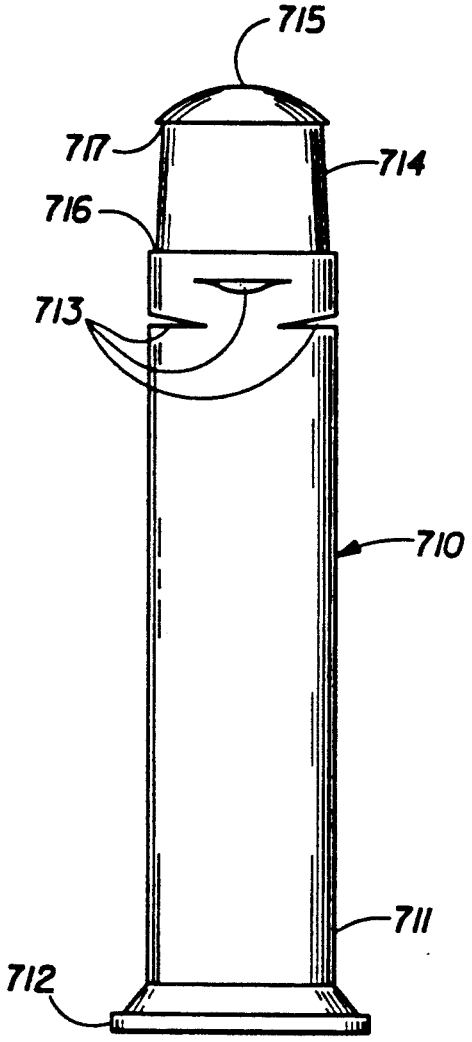
FIG. 22 is an elevational view of the pump piston of FIG. 21, with the inlet valve in the open position.

Yet another version of the third embodiment is depicted in FIGS. 21 and 22. FIG. 21 presents an elevational view of the pump piston, referred to generally by the numeral 710. The pump piston 710 includes a cylindrical outer wall 711 with an annular seal 712 at one end and a rounded tip 715 at the other end. The outer wall 711 has an annular channel 714 which extends around the periphery of the piston 710 in the vicinity of the rounded tip 715 for engaging the upper cap, generally denoted by the numeral 20 in FIGS. 2–6, in the manner previously described.

As shown in FIG. 21, the inlet valve according to this version of the third embodiment comprises three inlet valve slits 713 on one side of the piston wall 711, near the annular channel 714. The three inlet valve slits 713 preferably have equal lengths and are arranged such that the lower two slits are spaced apart circumferentially a distance slightly less than the length of the upper slit. In this fashion, the lower slits overlap each end of the upper slit circumferentially (similar to the valve slits depicted in FIGS. 15 and 16). This likewise defines an overlap, which is shown in FIG. 21 as the dimension "0". The slits 713 preferably extend over approximately 234 degrees of the piston surface, in order to maintain the structural integrity of the piston while permitting the required valving action. Given the approximate size of the prior art piston, this results in slits which are approximately ½ inches (12.7 mm) long. This overlap is also subject to variation, but preferably is between about zero and about ⅛ inches (0–3.2 mm), and most preferably is approximately 1/16 inches (1.6 mm). To maintain the necessary structural integrity of the piston 710, the slits are also preferably spaced apart longitudinally (axially) with respect to the piston. This spacing is preferably between about 1/16 and about ⅜ inches (1.6–9.6 Mm), and most preferably is approximately 1/16 inches (1.6 mm).

These dimensions have resulted in a pump piston assembly that performs well, based on the approximate size of the prior art piston assembly. When applied to other pump piston assemblies of differing materials and/or overall dimensions, the slit dimensions may need to be adjusted to achieve best results. While the illustrations depict slits of equal length, slits of unequal length (particularly small deviations) may perform acceptably.

In operation, to pressurize a container with a pump piston assembly according to this version of the third embodiment, the consumer draws the pump piston assembly upward with one hand while holding the container/cylinder assembly with the other hand. The frictional contact between the outer wall (denoted by the numeral 31 in FIG. 6) and annular seal 712 pulls open the inlet valve slits 713 to a position such as that shown in FIG. 22 to admit air into the interior of the piston 710. This opening of the valve slits is due to the inherent flexibility of the piston material. As the annular seal 712 nears the top of the outer wall, the user reverses the direction of travel and pushes downward on the upper cap. The frictional contact between the outer wall and the annular seal 712 now forces the inlet valve slits 713 into a closed, airtight position such as shown in FIG. 21. As the piston is moved downward, the air trapped within the piston and cylinder assembly is compressed and forced into the container via the valve which is part of the dispensing apparatus. The pump piston is cycled upward and downward, repeating the above steps, until the pressure within the container is adequate for dispensing (typically 10–15 cycles).

The dispensing and storage operations utilizing a pump piston according to this version of the third embodiment are precisely the same as those described with respect to the version of FIGS. 13 and 14.

It should be noted that in cases where the underlap of FIG. 13 and the overlap of FIG. 15 are both reduced to zero, the two respective versions of the third embodiment reduce to one version wherein the ends of the slits are vertically superimposed. The same holds true for the underlap of FIG. 19 and the overlap of FIG. 21. In such configurations, the performance characteristics (pumping force required and pressure obtained) fall roughly in between those of the underlap and overlap configurations.

It is also worth noting that the amount of overlap/underlap required is related to the longitudinal (axial) spacing between slits. As the longitudinal spacing increases, there is a larger "hinge" portion of the piston wall which must flex to open and close the slits. Correspondingly, the larger the longitudinal spacing, the greater the overlap required to provide satisfactory performance in terms of pumping force required and pressure obtained. Smaller spacings permit the overlap to be reduced or eliminated due to the reduction in "hinge" material, even to the point of an underlap configuration. For each given piston material, size, and geometry, there is generally a combination of underlap-/overlap and longitudinal spacing which produces the best overall performance.

With respect to FIGS. 14, 16, 18, 20, and 22, which depict the valve slits in the open position, the deflection of the valve slits has been somewhat exaggerated for illustrative purposes. The actual deflections experienced will vary with the flexibility of the piston material utilized, but are typically much smaller than those depicted and are often barely noticeable to the naked eye.

Although the versions of the third embodiment herein depicted and described illustrate the use of two or three slits, it is to be understood that the operative principles of the present invention are likewise applicable to other arrangements of two or three slits, as well as configurations employing greater numbers of slits.

While the illustrations and foregoing discussion of the third embodiment employing inlet valve slits have contemplated the slits being orientated perpendicularly to the longitudinal axis of the piston, the slits can also be positioned at an angle other than 90 degrees to the longitudinal axis. Likewise, the slits can extend through the outer wall of the piston an angle other than 90 degrees to the outer surface of the piston. Slits of unequal lengths could also be employed, particularly if the differences in length are comparatively small.

Although the foregoing illustrations and description have focused on the configuration wherein the pumping chamber and pump piston are disposed on the upper end of the container, such that they surround the dispensing apparatus, it will be apparent to one of ordinary skill in the art that the present invention may be applied equally well to other configurations, such as those with a separately located dispensing apparatus. The present invention may thus also be applied to configurations (inverted with respect to the foregoing illustrations) wherein the pumping chamber and pump piston extent upwardly into the bottom of the container.

While the normal range of operating pressures is largely dictated by the design of the dispensing apparatus, the prior art arrangement such as that depicted in FIG. 6 normally operates between about 30 psi (207 kPa) and about 5–7 psi (35–48 kPa). The pump pistons of all embodiments of the present invention produce approximately 30 psi (207 kPa) in a container sized according to the prior art after 10–15 pumping cycles. The prior art container has a total volume of approximately 18.2 cu. in. (297.8 cc), a "net" volume of approximately 16.5 cu. in. (271.0 cc) with the cylinder assembly installed, a "recommended fill level" of 11.3 cu. in. (185.0 cc) of liquid product, and hence a headspace of 5.2 cu. in. (85.2 cc) . Larger headspaces would require correspondingly more pumping strokes to achieve comparable pressures with a comparable piston/cylinder assembly.

The prior art pump piston and upper cap are currently injection molded, with each component formed as one unitary piece. This is currently a preferred method of manufacturing pump pistons and upper caps according to all embodiments of the present invention, although other manufacturing techniques may also be acceptable.

The dimensional sizes and spatial relationships given above, particularly with respect to the third embodiment, are based upon the use of a pump piston having dimensions approximating those of the prior art piston. For illustrative purposes, the overall length of the prior art pistons is approximately 3.5 inches (88.0 Mm), the outer wall diameter is approximately 0.67 inches (17.0 mm), the outer diameter of the annular seal is approximately 0.83 inches (21.0 mm), and the wall thickness is approximately 0.05 inches (1.2 mm). While these dimensions may be varied according to the sizes of the cylinder assembly and container employed, the dimensions relating to the improved inlet valves of the present invention may need to be varied accordingly..

The pump pistons and upper caps according to all embodiments of the present invention can be formed of the same materials as the prior art components, although a wide variety of other materials (particularly those in the polyolefin family) may also be acceptable. The preferred material for the pump pistons is polyethylene, and the preferred material for the upper caps is polypropylene (clarified polypropylene is preferred for transparent caps where dictated by aesthetics).

For both the pump pistons and the upper caps, the molten material is injected into machined tooling steel molds of the appropriate shape, which are then water cooled to solidify the formed parts. As an optional step, the pump pistons may be annealed to eliminate residual stresses within them and enhance their dimensional stability. An acceptable annealing process is to anneal the pistons at 55 degrees Celsius (130 degrees Fahrenheit) for 24 hours, although other annealing processes may also be acceptable.

To form the slits in the third embodiment of the present invention, the same technique used in the prior art may be utilized, although other methods may also be acceptable. In this method, which is presently preferred, the slits are formed by a guillotining process using a reciprocating knife after the pistons have cooled (and been annealed, if applicable) and prior to assembly with the upper cap.

It will be apparent to one skilled in the art that many variations of the present invention are possible. For example, the pump pistons may differ in size, thickness, and or cross-sectional shape from those disclosed above. Different materials may also be utilized, as well as different manufacturing techniques. Furthermore, depending on the physical properties of the materials used to form the upper caps and pump pistons, and their methods of manufacture, in order to obtain best results it may be necessary to vary the dimensions and spacings from those discussed above. In the case of the lost motion embodiments, the locations, sizes, and numbers of the apertures may be varied, and in the case of the embodiments employing valve slits, the locations, sizes, orientations, and numbers of slits may be varied as well. All such modifications and variations are within the scope and intent of the appended claims.

What is claimed is:

1. In a valved piston assembly for use with a liquid dispensing pump apparatus attached to a container, said liquid dispensing pump apparatus including dispensing means for dispensing a liquid product from said container and a cylinder assembly, said cylinder assembly having a cylindrical outer wall which is enclosed at one end by a bottom wall to define a pumping chamber, the improvement comprising:

(a) an upper cap having a generally circular top portion with a lower surface and an upper surface, said upper cap further having a generally cylindrical side wall attached at one end to said top portion and extending downwardly therefrom; and (b) an elongated tubular piston having a first end connected to said upper cap at said lower surface and a second end located remotely from said upper cap, said piston being concentrically disposed within said side wall, said piston being sized to be slideably received within said pumping chamber and including an annular seal at said second end for engaging said cylindrical outer wall, said piston further having a longitudinal axis extending therethrough defining an axial direction, said piston further including valve means located remotely from said second end for admitting air into said piston, said valve means being opened to admit air when an upward force is applied to said upper cap by a user and closed to form an airtight seal when a downward force is applied to said upper cap by a user;

whereby said piston and said pumping chamber cooperate to form an air pump for pressurizing said container, while said remotely located valve means is protected from contact with said liquid product throughout the liquid dispensing cycle, thereby avoiding degradation of sealing performance.

2. The improved valved piston assembly of claim 1, wherein said valve means comprises a plurality of slits extending through said piston.

3. The improved valved piston assembly of claim 2, wherein said slits are near said upper cap.

4. The improved valved piston assembly of claim 1, wherein said valve means comprises a lost motion connection between said upper cap and said piston.

5. The improved valved piston assembly of claim 1, wherein said piston is formed of polyethylene.

6. The improved valved piston assembly of claim 1, wherein said upper cap is formed of polypropylene.

7. In a valved piston assembly for use with a liquid dispensing pump apparatus attached to a container, said liquid dispensing pump apparatus including dispensing means for dispensing a liquid product from said container and a cylinder assembly surrounding said dispensing means, said cylinder assembly having a cylindrical outer wall which is enclosed at one end by a bottom wall to define a pumping chamber, the improvement comprising:

(a) an upper cap for enclosing said liquid dispensing pump apparatus, said upper cap having a generally circular top portion with a lower surface and an upper surface, said upper cap further having a generally cylindrical side wall attached at one end to said top portion and extending downwardly around said liquid dispensing pump apparatus; and (b) an elongated tubular piston having a first end connected to said upper cap at said lower surface and a second end located remotely from said upper cap, said piston being concentrically disposed within said side wall, said piston being sized to be slideably received within said pumping chamber and including an annular seal at said second end for engaging said cylindrical outer wall, said piston further having a longitudinal axis extending therethrough defining an axial direction, said piston further including valve means located remotely from said second end for admitting air into said piston, said valve means being opened to admit air when an upward force is applied to said upper cap by a user and closed to form an airtight seal when a downward force is applied to said upper cap by a user;

whereby said piston and said pumping chamber cooperate to form an air pump for pressurizing said container, while said remotely located valve means is protected from contact with said liquid product throughout the liquid dispensing cycle, thereby avoiding degradation of sealing performance.

8. The improved valved piston assembly of claim 7, wherein said valve means comprises a plurality of slits extending through said piston.

9. The improved valved piston assembly of claim 7, wherein said valve means comprises a lost motion connection between said upper cap and said piston.

10. In a valved piston assembly for use with a liquid dispensing pump apparatus attached to a container, said liquid dispensing pump apparatus including dispensing means for dispensing a liquid product from said container and a cylinder assembly surrounding said dispensing means, said cylinder assembly having a cylindrical outer wall which is enclosed at one end by a bottom wall to define a pumping chamber, the improvement comprising:

(a) an upper cap for enclosing said liquid dispensing pump apparatus, said upper cap having a generally circular top portion with a lower surface and an upper surface, said upper cap further having a generally cylindrical side wall attached at one end to said top portion and extending downwardly around said liquid dispensing pump apparatus; and (b) an elongated tubular piston having a first end connected to said upper cap at said lower surface and a second end located remotely from said upper cap, said piston being concentrically disposed within said side wall, said piston being sized to be slideably received within said pumping chamber and including an annular seal at said second end for engaging said cylindrical outer wall, said piston further having a longitudinal axis extending therethrough defining an axial direction, said piston further including valve means located remotely from said second end for admitting air into said piston, said valve means being opened to admit air when an upward force is applied to said upper cap by a user and closed to form an airtight seal when a downward force is applied to said upper cap by a user, said valve means comprising a plurality of slits extending through said piston, said slits being located near said upper cap, said slits further being spaced apart in said axial direction with respect to said piston;

whereby said piston and said pumping chamber cooperate to form an air pump for pressurizing said container, while said remotely located valve means is protected from contact with said liquid product throughout the liquid dispensing cycle, thereby avoiding degradation of sealing performance.

11. The improved valved piston assembly of claim 10, wherein said valve means comprises two slits extending through said piston.

12. The improved valved piston assembly of claim 11, wherein said two slits are disposed on one side of said piston.

13. The improved valved piston assembly of claim 11, wherein said two slits are disposed in diametrically opposed locations on said piston.

14. The improved valved piston assembly of claim 13, wherein said two slits are spaced apart circumferentially with respect to said piston.

15. The valved piston assembly of claim 10, wherein said valve means comprises three slits extending through said piston.

16. The improved valved piston assembly of claim 10, wherein said slits coextend along a portion of their length.

17. The improved valved piston assembly of claim 10, wherein said slits are spaced apart circumferentially with respect to said piston.

18. In a valved piston assembly for use with a liquid dispensing pump apparatus attached to a container, said liquid dispensing pump apparatus including dispensing means for dispensing a liquid product from said container and a cylinder assembly surrounding said dispensing means, said cylinder assembly having a cylindrical outer wall which is enclosed at one end by a bottom wall to define a pumping chamber, the improvement comprising:

(a) an upper cap for enclosing said liquid dispensing pump apparatus, said upper cap having a generally circular top portion with a lower surface and an upper surface, said upper cap further having a generally cylindrical side wall attached at one end to said top portion and extending downwardly around said liquid dispensing pump apparatus; and (b) an elongated tubular piston having a first end connected to said upper cap at said lower surface and a second end located remotely from said upper cap, said piston being concentrically disposed within said side wall, said piston being sized to be slideably received within said pumping chamber and including an annular seal at said second end for engaging said cylindrical outer wall, said piston further having a longitudinal axis extending therethrough defining an axial direction, said piston further including valve means located remotely from said second end for admitting air into said piston, said valve means being opened to admit air when an upward force is applied to said upper cap by a user and closed to form an airtight seal when a downward force is applied to said upper cap by a user, said valve means comprising a lost motion connection between said upper cap and said piston, said lost motion connection comprising a conduit unitarily formed with said lower surface of said upper cap and extending downwardly from said lower surface for engaging said piston;

whereby said piston and said pumping chamber cooperate to form an air pump for pressurizing said container, while said remotely located valve means is protected from contact with said liquid product throughout the liquid dispensing cycle, thereby avoiding degradation of sealing performance.

19. The improved valved piston assembly of claim 18, wherein said piston is formed with an outer edge at said first end, said conduit is generally tubular in shape, and said conduit further includes engaging means for engaging said outer edge to retain said piston in engagement with said upper cap and limit relative motion between said upper cap and said piston.

20. The improved valved piston assembly of claim 19, wherein said piston is formed with a sealing surface at said first end and said upper cap is formed with a sealing ring, said sealing surface and said sealing ring cooperate to form an airtight seal when a downward force is applied to said upper cap by a user, said piston further being open at both ends.

21. The improved valved piston assembly of claim 20, wherein said upper cap is formed with at least one aperture in said upper surface, said at least one aperture being located outwardly of said sealing ring and located outwardly of said sealing surface.

22. The improved valved piston assembly of claim 19, wherein said engaging means comprises segments of an annular ring.

23. The improved valved piston assembly of claim 18, wherein said piston is formed with a tapered shoulder at said first end, said conduit is tapered, and said tapered shoulder and said conduit cooperate to form an airtight seal when a downward force is applied to said upper cap by a user, said piston further having top wall such that said first end is closed.

24. The improved valved piston assembly of claim 23, wherein said piston is formed with a retaining lip at said first end, said retaining lip and said tapered shoulder cooperating with said conduit to retain said piston in engagement with said upper cap and limit relative motion between said upper cap and said piston.

25. The improved valved piston assembly of claim 24, wherein said piston has at least one aperture extending through said tapered shoulder.

* * * * *